US006195048B1

(12) United States Patent
Chiba et al.

(10) Patent No.: US 6,195,048 B1
(45) Date of Patent: Feb. 27, 2001

(54) MULTIFREQUENCY INVERTED F-TYPE ANTENNA

(75) Inventors: Norimichi Chiba, Hino; Takashi Amano, Soka; Hisao Iwasaki, Tama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/355,525

(22) PCT Filed: Dec. 1, 1998

(86) PCT No.: PCT/JP98/05400

§ 371 Date: Jul. 29, 1999

§ 102(e) Date: Jul. 29, 1999

(87) PCT Pub. No.: WO99/28990

PCT Pub. Date: Jun. 10, 1999

(30) Foreign Application Priority Data

Dec. 1, 1997 (JP) ..... 9-329824

(51) Int. Cl.[7] ..... H01Q 1/38

(52) U.S. Cl. ..... 343/700 MS; 343/767

(58) Field of Search ..... 343/700 MS, 767, 343/770, 846, 868

(56) References Cited

U.S. PATENT DOCUMENTS

| | | | | |
|---|---|---|---|---|
| 4,700,194 | * | 10/1987 | Ogawa et al. | 343/700 MS |
| 4,766,440 | * | 8/1988 | Gegan | 343/700 MS |
| 5,400,041 | * | 3/1995 | Strickland | 343/700 MS |
| 5,986,606 | * | 11/1999 | Kossiavas et al. | 343/700 MS |

FOREIGN PATENT DOCUMENTS

| | | |
|---|---|---|
| 61-171307 | 10/1986 | (JP) . |
| 64-8823 | 1/1989 | (JP) . |
| 10-93332 | 4/1998 | (JP) . |

* cited by examiner

*Primary Examiner*—Tan Ho
(74) *Attorney, Agent, or Firm*—Finnegan, Henderson, Farabow, Garrett & Dunner, L.L.P.

(57) ABSTRACT

A multifrequency inverted F-type antenna which can receive muntifrequency band radio waves without the enlargement of its shape. A cut-out part (12*b*) is formed in an emission conductor (12) one end of which is connected to a short-circuit plate (13) planted in a ground conductor (11) and which has a feeding point (12*a*) to form on the emission conductor (12) a first emission conductor (12-1) and a second emission conductor (12-2) which resonate at respective frequency bands different from each other. By this construction the radio waves of two different frequency bands, i.e. a first frequency band determined by the shape of the first emission conductor (12-1) and a second frequency band determined by the shape of the second emission conductor (12-2), can be received.

14 Claims, 23 Drawing Sheets

MULTIFREQUENCY INVERTED F-TYPE ANTENNA

TECHNICAL FIELD

The present invention relates to a multifrequency inverted F-type antenna used as an internal antenna of small, thin radio communication terminals such as, chiefly, portable telephones, and more particularly, it relates to a multifrequency inverted F-type antenna capable of receiving radio waves in multiple frequency bands without increasing its size.

BACKGROUND ART

In general, inverted F-type antennas have excellent characteristics as internal antennas of small, thin radio terminals typified by portable telephones.

FIG. 21 is a perspective view showing the typical construction of a conventional inverted F-type antenna.

Referring to FIG. 21, in the inverted F-type antenna 210, an emission conductor 212 is arranged opposite a ground conductor 211, the emission conductor 212 being connected to the ground conductor 2112 through a ground conductor 213.

Also, a feeding point 212*a* is provided on emission conductor 212, and power is supplied to the feeding point 212*a* by means of a coaxial feeding line 214 from power feeding source 215 through a hole 211 a provided in ground conductor 211.

As is known, assuming that the length of emission conductor 212 is L1 as shown in FIG. 21, the inverted F-type antenna 210 resonates with the frequency at which the length L1 is about $\lambda/4$ (where $\lambda$ is the wavelength).

However, with radio terminals of this type, it is demanded that the inverted F-type antenna should be capable of receiving two or more different frequency bands together in order for example to be capable of being employed in two or more systems.

The constructions shown in FIG. 22 or FIG. 23 are known as conventional constructions whereby it is made possible to receive two or more different frequency bands together, using an inverted F-type antenna.

FIG. 22 is a perspective view showing a conventional multifrequency inverted F-type antenna that is capable of receiving two or more different frequency bands together.

Referring to FIG. 22, in the multifrequency inverted F-type antenna 220, two emission conductors 222-1 and 222-2 of different size are arranged in parallel with respect to ground conductor 221; these two emission conductors 222-1 and 222-2 are connected to ground conductor 221 through respective ground conductors 223-1 and 223-2; power is supplied to feeding point 222-1 a on emission conductor 222-1 from power feeding source 225-1 by coaxial feeding line 224-1 and power is supplied to feeding point 222-2*a* on emission conductor 222-2 from power feeding source 225-2 by coaxial feeding line 224-2.

Specifically, in the multifrequency inverted F-type antenna 220 shown in FIG. 22, an arrangement is adopted whereby two single-frequency inverted F-type antennas that resonate in respectively different frequency bands are arranged adjacently; as a result, there is the problem that the installation area becomes large in order to permit the arrangement of these two single-frequency inverted F-type antennas.

FIG. 23 is a perspective view showing another conventional multifrequency inverted F-type antenna which is capable of receiving two or more different frequency bands at once.

Referring to FIG. 23, in the multifrequency inverted F-type antenna 230, two emission conductors 232-1 and 232-2 of different size are arranged in stacked fashion relative to ground conductor 231, these two emission conductors 232-1 and 232-2 being connected to ground conductor 231 through respective ground conductors 233-1, 233-2; feeding point 232-1 a on emission conductor 232-1 is supplied with power from power feeding source 235-1 by coaxial feeding line 234-1, while feeding point 232-2*a* on emission conductor 232-2 is supplied with power from power feeding source 235-2 by means of coaxial feeding line 234-2.

Specifically, with the construction shown in FIG. 23, two single-frequency inverted F-type antennas that resonate in respectively different frequency bands are arranged in stacked fashion; as a result, there is the problem that the installation volume becomes large owing to the increased height of the installation region in order to provide for the stacked arrangement of these two single-frequency inverted F-type antennas.

Thus, there was the problem that, with a conventional multifrequency inverted F-type antenna arranged to be capable of receiving simultaneously two or more different frequency bands, there was the problem that the installation area or installation volume became larger than that of a conventional single-frequency inverted F-type antenna, thereby presenting an obstacle to reducing the size and thickness of a radio terminal accommodating such a multifrequency inverted F-type antenna.

DISCLOSURE OF THE INVENTION

Accordingly, an object of the present invention is to provide a multifrequency inverted F-type antenna whereby radio waves of multiple frequency bands can be received without increase in size.

In order to achieve this object, the invention according to claim 1 is a multifrequency inverted F-type antenna comprising: a ground conductor; a short-circuit plate planted in the ground conductor; a first emission conductor arranged facing the short-circuit plate, having a cut-out part in its interior, and whose one end is connected to the short-circuit plate; and a second emission conductor arranged facing the short-circuit plate and formed within the cutout part of the first emission conductor.

Also, in the invention according to claim 2, in the invention of claim 1, the first emission conductor comprises a feeding point connection part whereby connection of the feeding point is effected, between the cut-out part and the short-circuit plate.

Also, in the invention according to claim 3, in the invention of claim 1, the second emission conductor is formed integrally with the first emission conductor.

Also, in the invention according to claim 4, in the invention of claim 1, the second emission conductor has a single projection and operates in two frequency bands dependent on the shape of the first emission conductor and the shape of the second emission conductor.

Also, in the invention according to claim 5, in the invention of claim 4, the first spacing between the first emission conductor and the ground conductor and the second spacing between the second emission conductor and the ground conductor are set to respectively different distances.

Also, in the invention according to claim 6, in the invention of claim 4, dielectric elements are arranged between at least one of either the first emission conductor and the ground conductor or the second emission conductor and the ground conductor, the first dielectric constant between the first emission conductor and the ground conductor and the second dielectric constant between the second emission conductor and the ground conductor being different.

Also, in the invention according to claim 7, in the invention of claim 1, the second emission conductor has a plurality of projections and operates in a plurality of frequency bands dependent on the shape of the first emission conductor and the shape of the second emission conductor.

Also, in the invention according to claim 8, in the invention of claim 7, the first spacing between the first emission conductor and the ground conductor and a plurality of second spacings between the projections of the second emission conductor and the ground conductor are set to respectively different distances.

Also, in the invention according to claim 9, in the invention of claim 7, a dielectric element is arranged in at least one of the spacings between the first emission conductor and the ground conductor and between the projections of the second emission conductor and the ground conductor, and the first dielectric constant between the first emission conductor and the ground conductor and the second dielectric constant between the projections of the second emission conductor and the ground conductor, respectively, are made to be different.

Also, in the invention according to claim 10, in the invention of claim 2, the feeding point is arranged in the middle of the feeding point connection part in the width direction of the first emission conductor.

Also, in the invention according to claim 11, in the invention of claim 2, the feeding point is arranged at a position of the feeding point connection part offset by a prescribed distance from the middle in the width direction of the first emission conductor.

Also, in the invention according to claim 12, in the invention of claim 1, the short-circuit plate is formed of the same length as the length in the width direction of the first emission conductor.

Also, in the invention according to claim 13, in the invention of claim 1, the short-circuit plate is formed of shorter length than the length in the width direction of the first emission conductor and with its center offset from the center in the width direction of the first emission conductor.

BEST MODE FOR CARRYING OUT THE INVENTION

Embodiments of a multifrequency inverted F-type antenna according to the present invention are described below with reference to the appended drawings.

Figure 1:
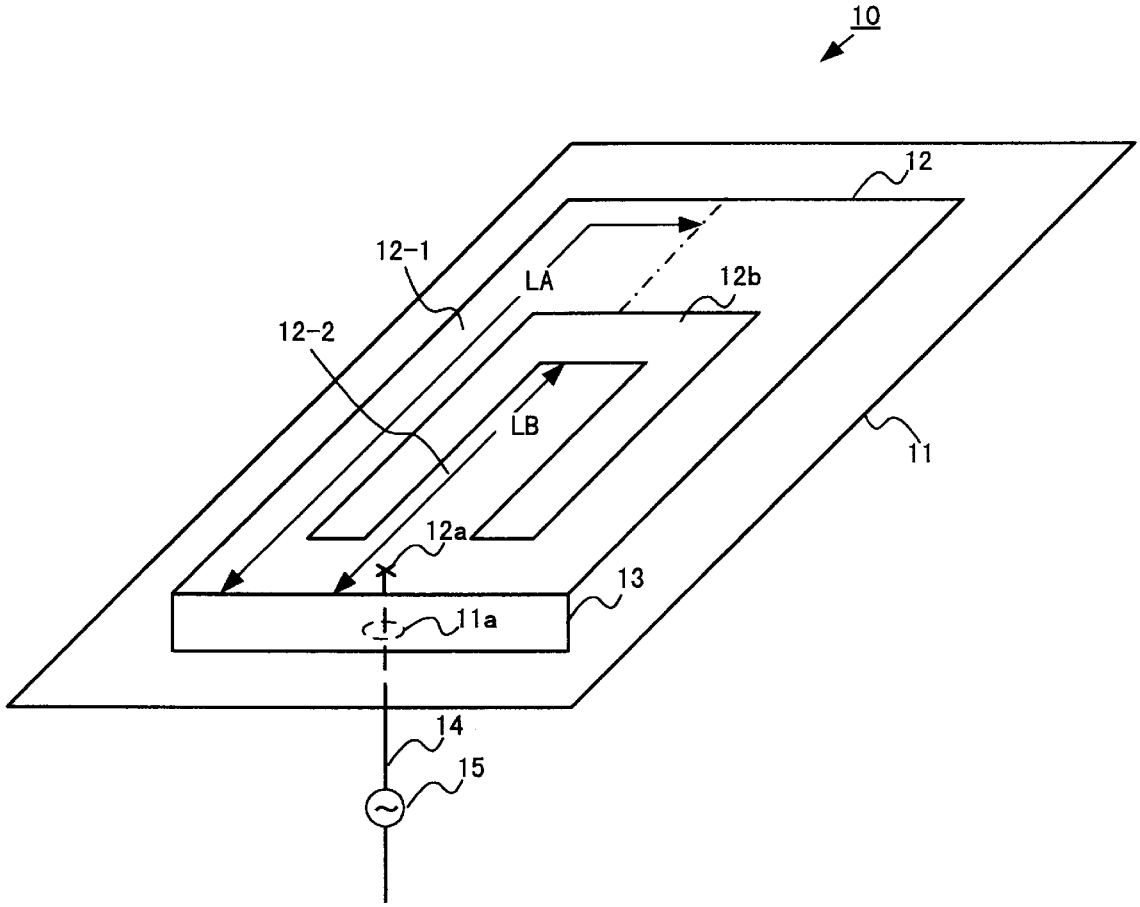
FIG. 1 is a perspective view showing a first embodiment of a multifrequency inverted F-type antenna according to the present invention.

FIG. 1 is a perspective view showing a first embodiment of a multifrequency inverted F-type antenna according to the present invention.

Referring to FIG. 1, in the multifrequency inverted F-type antenna 10, there are formed a first emission conductor 12-1 and second emission conductor 12-2 that resonate in respectively different frequency bands on an emission conductor 12 by forming a cut-out part 12*b* in the emission conductor 12, which is provided with a feeding point 12*a* and whose one end is connected to a short-circuit plate 13 planted in ground conductor 11. With this construction, it is capable of receiving radio waves of two different frequency bands: a first frequency band determined by the shape of first emission conductor 12-1 and a second frequency band determined by the shape of second emission conductor 12-2.

Specifically, a first emission conductor 12-1 of resonance length LA in FIG. 1 and a second emission conductor 12-2 of resonance length LB in FIG. 1 are formed on emission conductor 12. One end of the emission conductor 12 is connected to ground conductor 11 through short-circuit plate 13 and power is supplied to a single feeding point 12*a* of the emission conductor 12 by a coaxial feeding line 14 from power feeding source 15 through a hole 11 a provided in ground conductor 11.

With this construction, the multifrequency inverted F-type antenna 10 resonates in a first frequency band wherein length LA is about $\lambda/4$ ($\lambda$ is the wavelength) by means of first emission conductor 12-1, and resonates in a second frequency band wherein length LB is about $\lambda/4$ ($\lambda$ is the wavelength) by means of second emission conductor 12-2. As a result, the multifrequency inverted F-type antenna 10 becomes capable of receiving radio waves of two frequency bands, namely, the first frequency band and second frequency band, without increase of installation area or installation volume.

Figure 22:
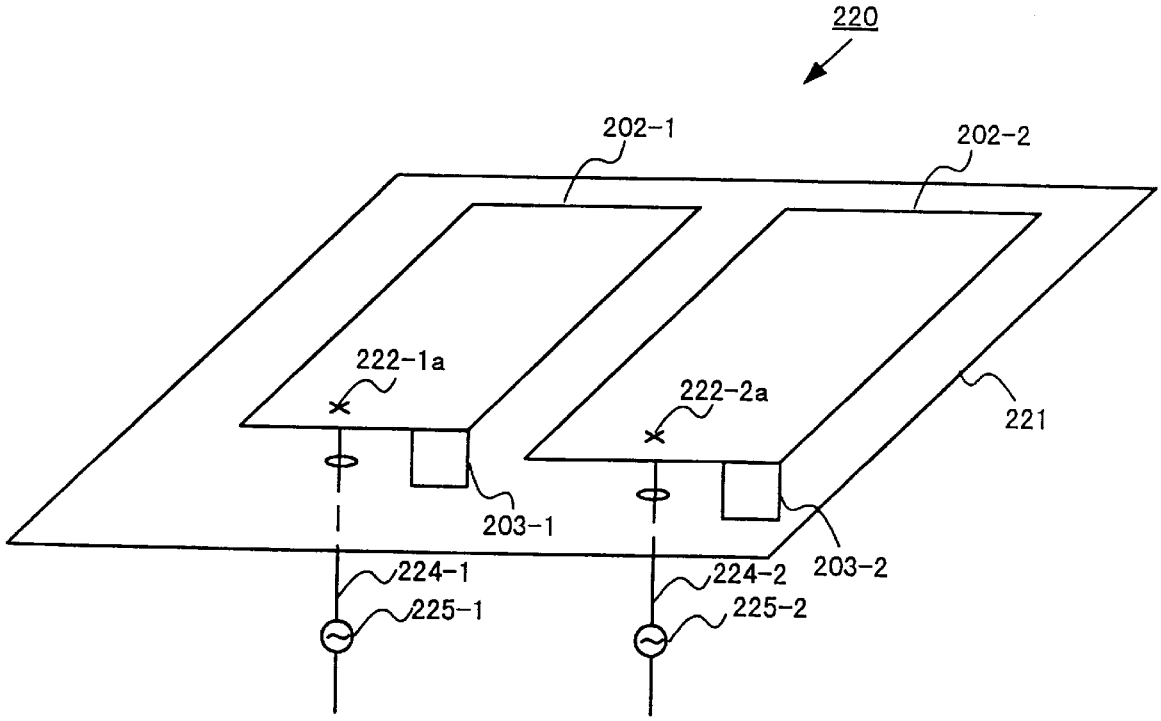
FIG. 22 Prior Art
FIG. 22 is a perspective view showing a conventional multifrequency inverted F-type antenna arranged to be capable of receiving simultaneously two or more different frequency bands.
Figure 23:
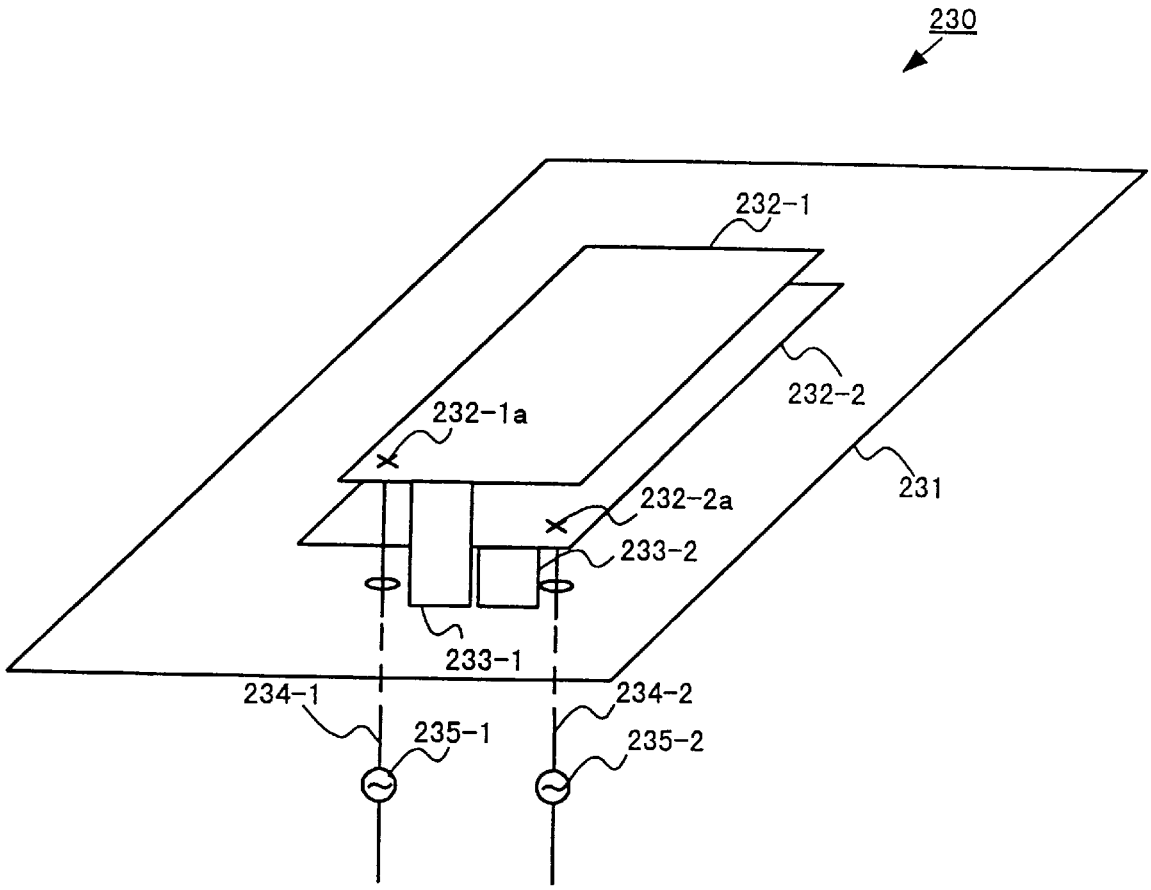
FIG. 23 Prior Art
FIG. 23 is a perspective view showing another conventional multifrequency F-type antenna constructed so as to be capable of receiving simultaneously two or more different frequency bands.

Specifically, as regards installation area, the multifrequency inverted F-type antenna 10 shown in FIG. 1 has the same installation area as a conventional single-frequency inverted F-type antenna that resonates in the first frequency band wherein length LA is about $\lambda/4$ (where $\lambda$ is the wavelength). As regards installation height (installation volume), it has the same installation height (installation volume) as a conventional single-frequency inverted F-type antenna that resonates in the first frequency band wherein length LA is about $\lambda/4$ (where $\lambda$ is the wavelength). A multifrequency inverted F-type antenna which is smaller in size and thinner than the conventional multi-frequency antennas shown in FIG. 22 and FIG. 23 can thereby be realized. That is, the multifrequency inverted F-type antenna 10 shown in FIG. 2 does not need to have its installation area and installation volume increased in order to resonate in the second frequency band wherein length LB is about $\lambda/4$ (where $\lambda$ is the wavelength).

Figure 2:
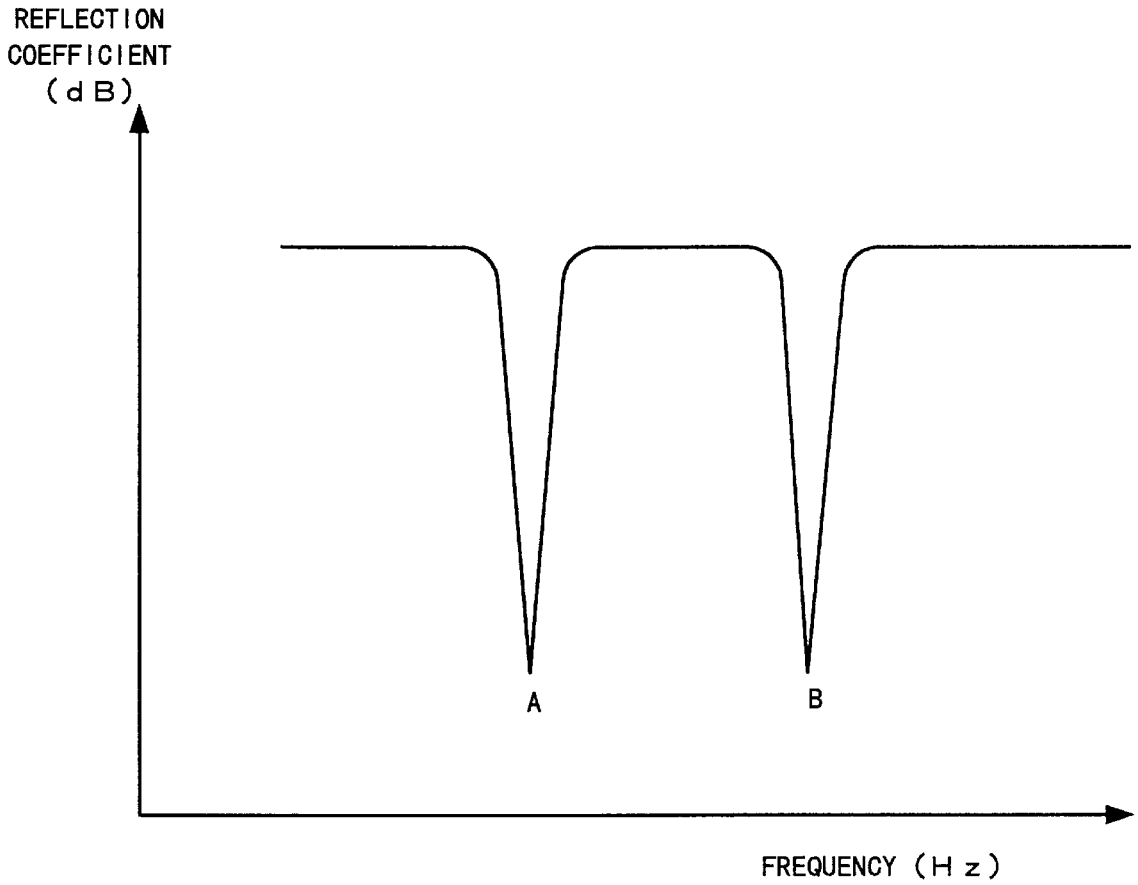
FIG. 2 is a diagram showing the frequency characteristic of the multifrequency inverted F-type antenna 10 shown in FIG. 1.

FIG. 2 is a diagram showing a frequency characteristic of the multifrequency inverted antenna 10 shown in FIG. 1.

In FIG. 2, the vertical axis shows the reflection coefficient (dB) at feeding point 12*a* of the multifrequency inverted F-type antenna 10, while the horizontal axis shows frequency (Hz).

As is clear from FIG. 2, the multifrequency inverted F-type antenna 10 has two sharp resonant points at frequency A and frequency B; frequency A is determined by the shape of first emission conductor 12-1 of resonance length LA, while frequency B is determined by the shape of second emission conductor 12-1 of resonance length LB.

Specifically, the multifrequency inverted F-type antenna 10 shown in FIG. 1 is capable of receiving radio waves in two frequency bands, namely, a first frequency band determined by the shape of first emission conductor 12-1 and a second frequency band determined by the shape of second emission conductor 12-2.

Figure 3:
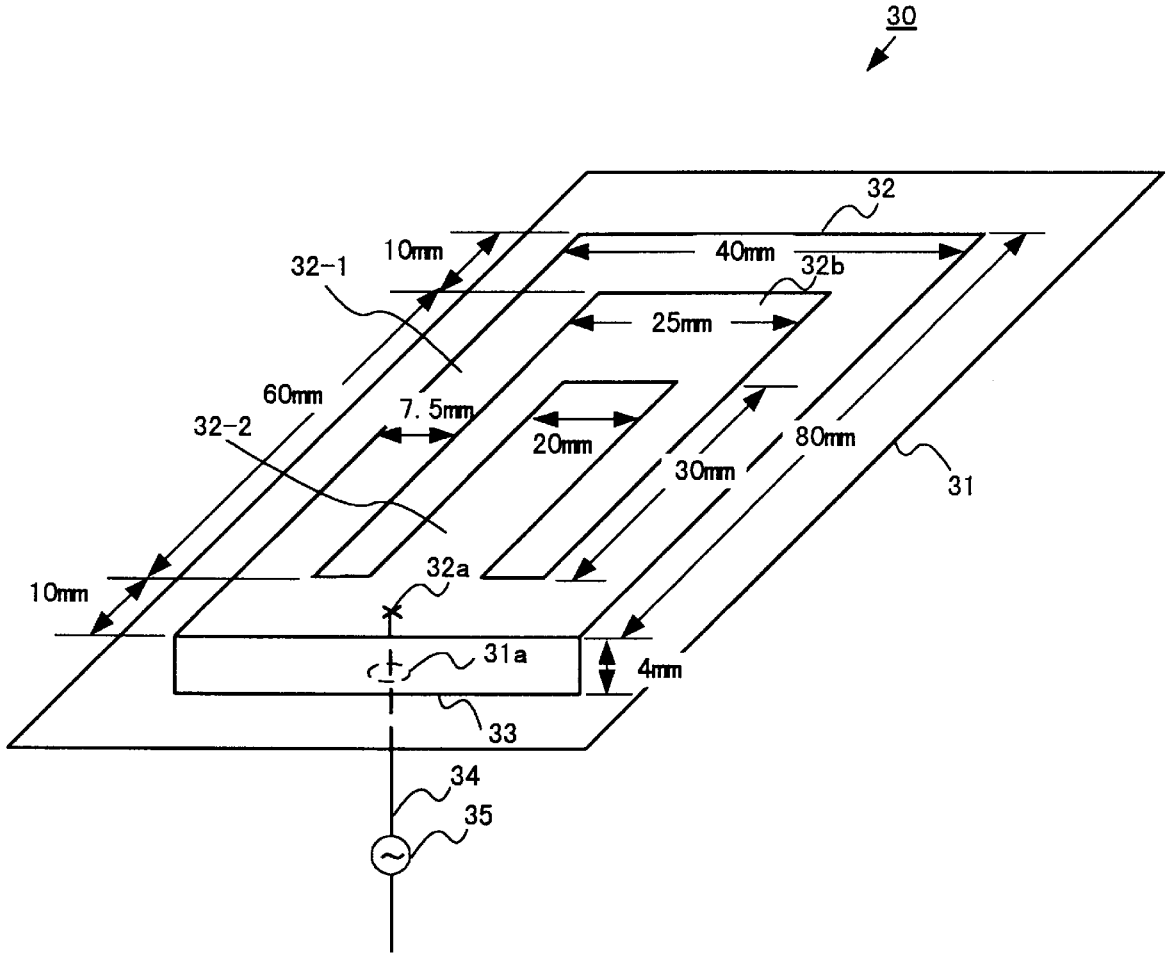
FIG. 3 is a perspective view showing a multifrequency inverted F-type antenna 30 constituted by applying specific dimensions of the multifrequency inverted F-type antenna 10 shown in FIG. 1.

FIG. 3 is a perspective view showing a multifrequency inverted F-type antenna 30 constituted by supplying specific dimensions of the multifrequency inverted F-type antenna 10 shown in FIG. 1.

Referring to FIG. 3, in the multifrequency inverted F-type antenna 30, emission conductor 32 is constituted of a size: 80 mm×40 mm and one 40 mm side of the emission conductor 32 is connected to a ground conductor 31 through a short-circuit plate 33 of size 40 mm×4 mm. In emission conductor 32, there is formed a practically U-shaped cut-out part 32*b* of external width 25 mm, internal width 20 mm, and height 60 mm, leaving a feeding point connection part of width 10 mm for forming feeding point 32*a*.

In this way, on emission conductor 32, there are formed a first emission conductor 32-1 of approximately U-shape of external width 40 mm, internal width 25 mm and height 70 mm connected to a feeding point connection part of width 10 mm, and a second emission conductor 32-2 having a rectangular shape of 20 mm×30 mm and connected to the feeding point connection part of width 10 mm.

Thus, the first emission conductor 32-1 having an approximately U shape of external width 40 mm, internal width 25 mm and height 70 mm that is connected to the feeding point connection part of width 10 mm constitutes a first inverted F-type antenna that resonates in the first frequency band, while the second emission conductor 32-2 having a rectangular shape of 20 mm×30 mm connected to the feeding point connection part of width 10 mm constitutes a second inverted F-type antenna that resonates in the second frequency band.

The feeding point connection part of width 10 mm has the function of matching the first inverted F-type antenna and second inverted F-type antenna.

Power is supplied to a single feeding point 32*a* of emission conductor 32 by means of coaxial feeding line 34 from power feeding source 35, through a hole 31*a* provided in ground conductor 31.

The multifrequency inverted F-type antenna 30 shown in FIG. 3 may be assumed to be the internal antenna of a portable telephone constituting a dual-mode terminal capable of sending and receiving under the two systems: GSM (Global System for Mobile Communication) and PHS (Personal Handyphone System); by means of the first inverted F-type antenna and second inverted F-type antenna described above, a multifrequency inverted F-type antenna is realized that is capable of sending and receiving in the GSM radio frequency 800 MHz band and PHS radio frequency 109 GHz band.

Next, the results of analysis of the radiation pattern of the multifrequency inverted F-type antenna 300 illustrated in FIG. 3 will be described.

Figure 4:
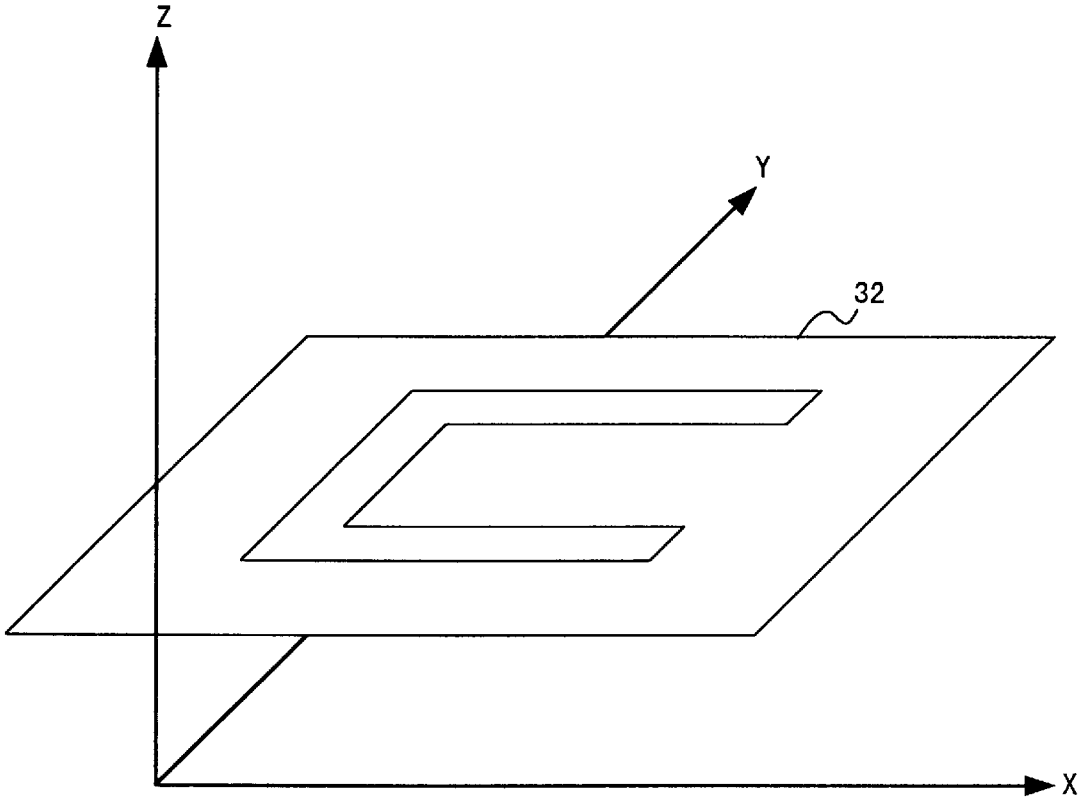
FIG. 4 is a view showing a coordinate system for analyzing the radiation pattern of the multifrequency inverted F-type antenna 300 shown in FIG. 3.

FIG. 4 is a diagram illustrating a coordinate system for the purposes of analysis of the radiation pattern of the multifrequency inverted F-type antenna 300 illustrated in FIG. 3.

Referring to FIG. 4, in the coordinate system for analysis of the radiation pattern of the multifrequency inverted F-type antenna 300 illustrated in FIG. 3, the direction orthogonal to the surface of the emission conductor 302 is defined as the Z axis, the longest axis direction of emission conductor 302 is defined as the X axis, and the shortest axis direction is defined as the Y axis.

Figure 5:
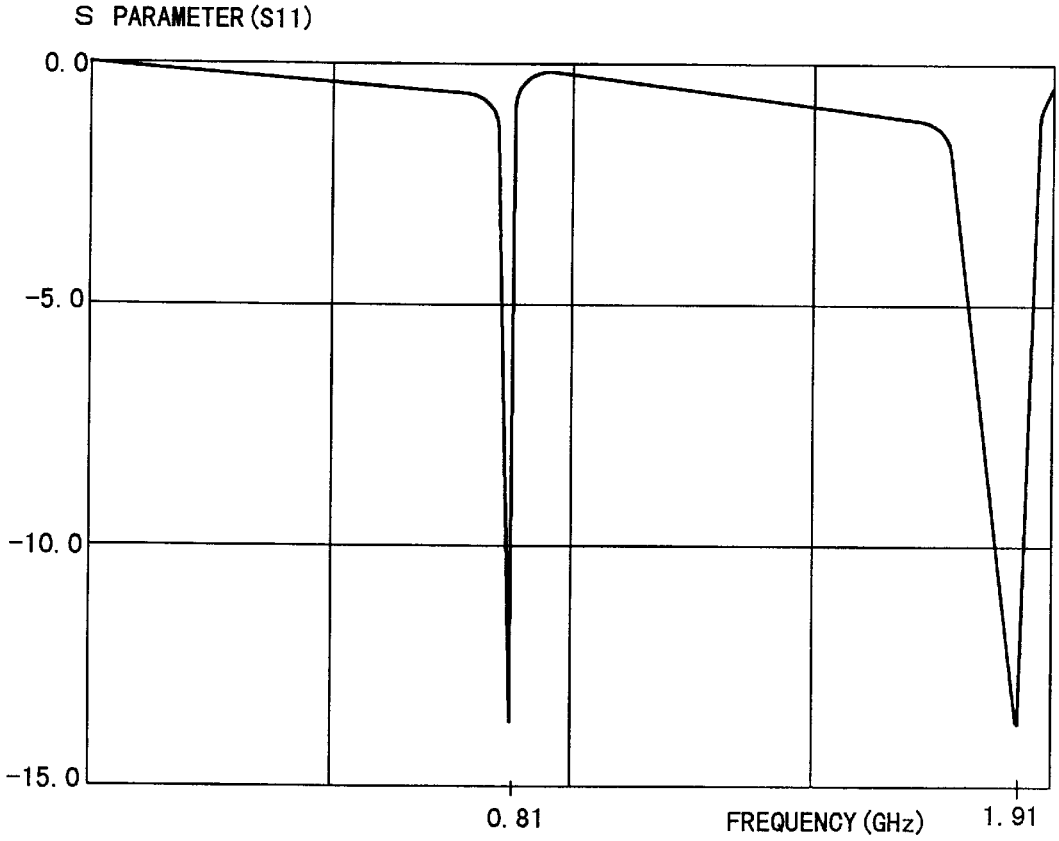
FIG. 5 is a diagram showing the reflection characteristic at the antenna feeding point when analyzed using electromagnetic field analysis (method of moments) on the characteristic of the multifrequency inverted F-type antenna 300 shown in FIG. 3.

FIG. 5 is a diagram showing the reflection characteristic at the antenna feeding point when the characteristic of the multifrequency inverted F-type antenna 300 shown in FIG. 3 is analyzed using electromagnetic field analysis (method of moments).

In FIG. 5, the vertical axis shows the reflection characteristic i.e. the S parameter (S11) at the antenna feeding point and the horizontal axis shows the frequency (GHz).

As is clear from FIG. 5, the multifrequency inverted F-ype antenna 300 illustrated in FIG. 3 realizes a multifrequency inverted F-type antenna that is capable of receiving both the GSM radio frequency 800 MHz band and PHS radio frequency 109 GHz band.

Figure 6:
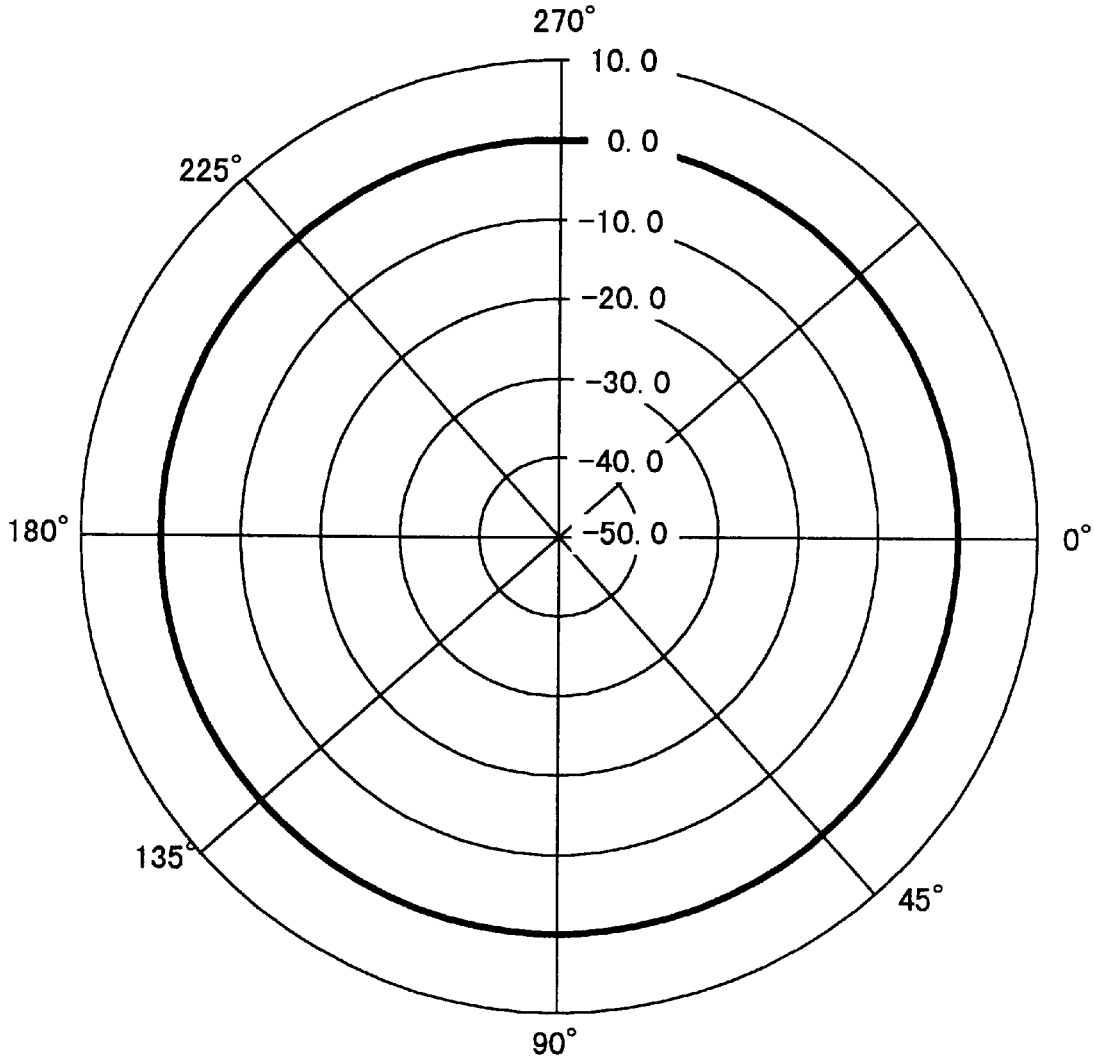
FIG. 6 is a radiation pattern diagram showing the results of analysis of the radiation pattern (X-Y plane in FIG. 4) in the 800 MHz band of the multifrequency inverted F-type antenna 300 shown in FIG. 3.

FIG. 6 is a radiation pattern diagram illustrating the results of analysis of the radiation pattern (in the X-Y plane of FIG. 4) in the 800 MHz band of the multifrequency inverted F-type antenna 300 illustrated in FIG. 3.

Figure 7:
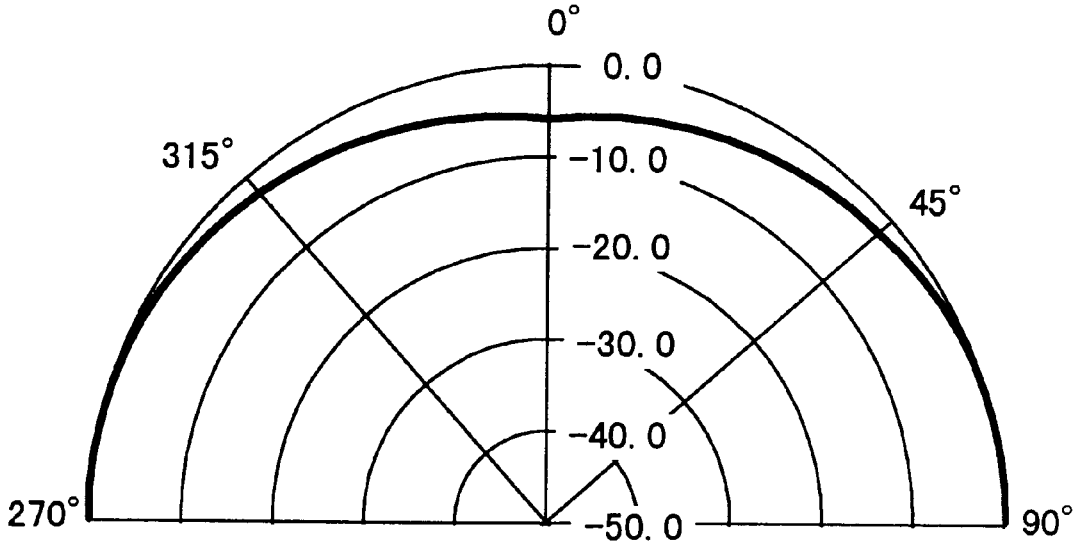
FIG. 7 is a radiation pattern diagram showing the results of analysis of the radiation pattern (X-Z plane of FIG. 4) in the 800 MHz band of the multifrequency inverted F-type antenna 300 shown in FIG. 3.

FIG. 7 is a radiation pattern diagram illustrating the results of analysis of the radiation pattern (X-Z plane in FIG. 4) in the 800 MHz band of the multifrequency inverted F-type antenna 300 illustrated in FIG. 3.

Figure 8:
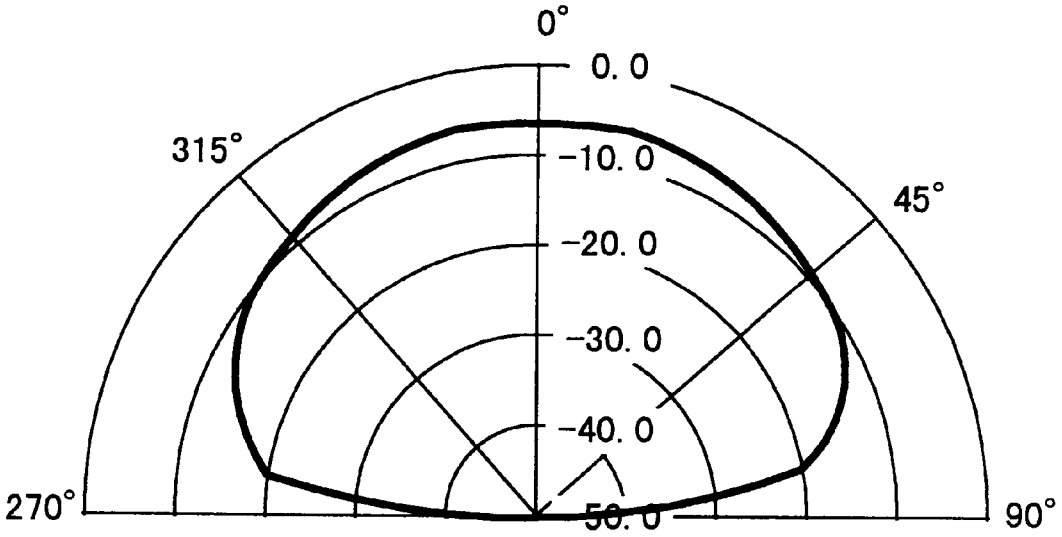
FIG. 8 is a radiation pattern diagram showing the results of analysis of the radiation pattern (Y-Z plane in FIG. 4) in the 800 MHz band of the multifrequency inverted F-type antenna 300 shown in FIG. 3.

FIG. 8 is a radiation pattern diagram illustrating the results of analysis of the radiation pattern (Y-Z plane in FIG. 4) in the 800 MHz band of the multifrequency inverted F-type antenna 300 illustrated in FIG. 3.

As is clear from FIG. 6 to FIG. 8, although the multifrequency inverted F-type antenna 300 illustrated in FIG. 3 shows some deterioration in the 800 MHz band as regards the X-Z plane radiation pattern and Y-Z plane radiation pattern, it has practically the same directionality as a one-sided short-circuit patch and has the same performance as an 800 MHz band single-frequency inverted F-type antenna.

Figure 9:
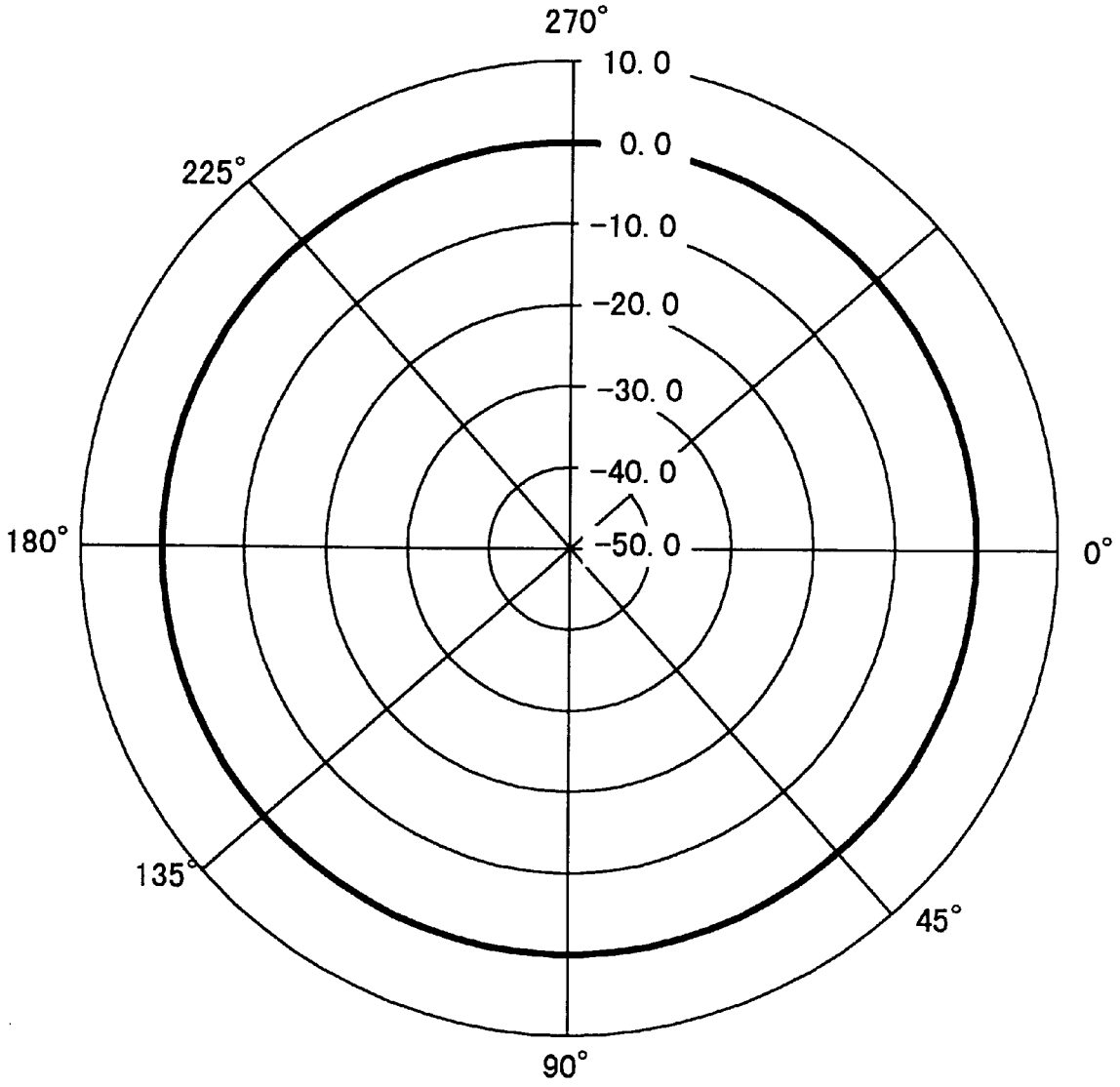
FIG. 9 is a radiation pattern diagram showing the results of analysis of the radiation pattern (X-Y plane in FIG. 4) in the 1.9 GHz band of the multifrequency inverted F-type antenna 300 shown in FIG. 3.

FIG. 9 is a radiation pattern diagram showing the results of analysis of the radiation pattern (X-Y plane of FIG. 4) in the 1.9 GHz band of the multifrequency inverted F-type antenna 300 shown in FIG. 3.

Figure 10:
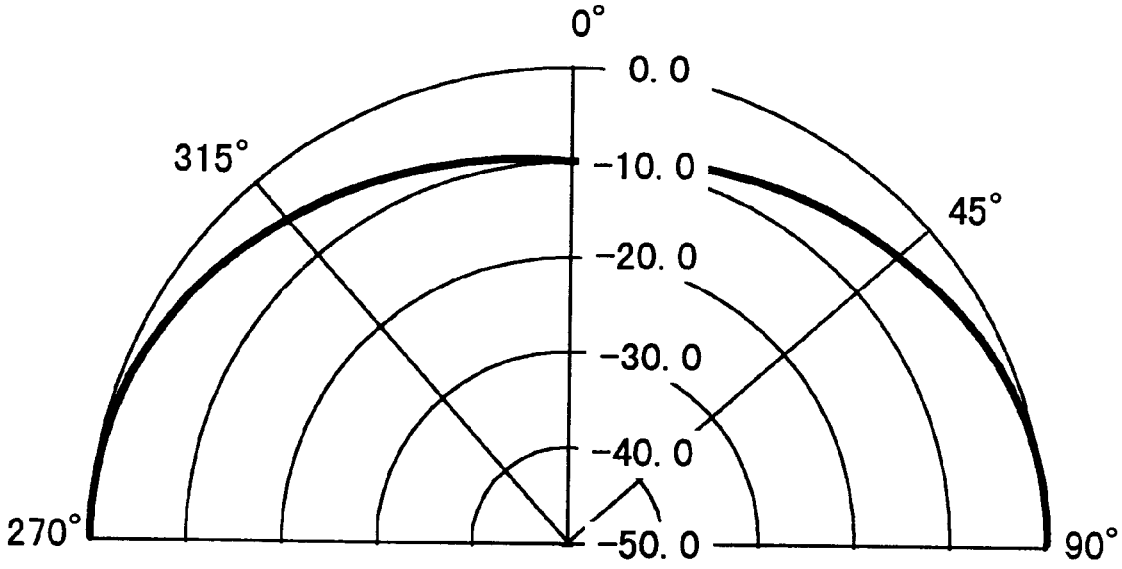
FIG. 10 is a radiation pattern diagram showing the results of analysis of the radiation pattern (X-Z plane in FIG. 4) in the 1.9 GHz band of the multifrequency inverted F-type antenna 300 shown in FIG. 3.

FIG. 10 is a radiation pattern diagram showing the results of analysis of the radiation pattern (X-Z plane in FIG. 4) in the 1.9 GHz band of the multifrequency inverted F-type antenna 300 shown in FIG. 3.

Figure 11:
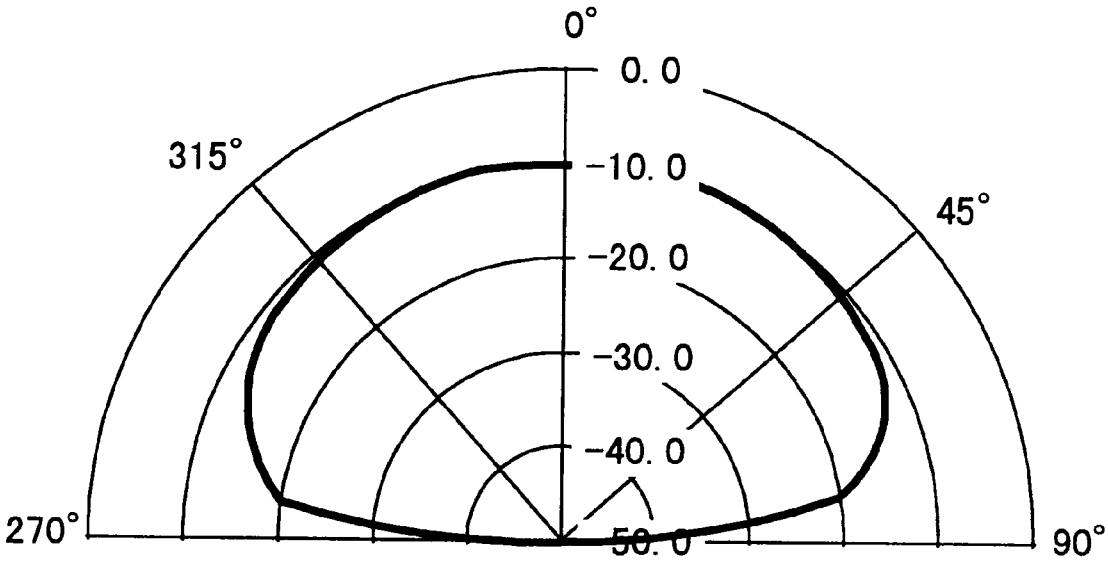
FIG. 11 is a radiation pattern diagram showing the results of analysis of the radiation pattern (Y-Z plane in FIG. 4) in the 1.9 GHz band of the multifrequency inverted F-type antenna 300 shown in FIG. 3.

FIG. 11 is a radiation pattern diagram showing the results of analysis of the radiation pattern (Y-Z plane in FIG. 4) in the 1.9 GHz band of the multifrequency inverted F-type antenna 300 shown in FIG. 3.

As is clear from FIG. 9 and FIG. 11, the multifrequency inverted F-type antenna 300 shown in FIG. 3 shows some deterioration in the X-Z plane radiation pattern and Y-Z plane radiation pattern in the 1.9 GHz band, but it has practically the same directionality as a one-sided short-circuit patch and has the same performance as a 1.9 GHz band single-frequency inverted F-type antenna.

In this way, with the multifrequency inverted F-type antenna 300 shown in FIG. 3, a small and thin multifrequency inverted F-type antenna can be realized, which can provide a multifrequency inverted F-type antenna that is capable of being adopted as the internal antenna of dual-mode terminals of various types.

Figure 12:
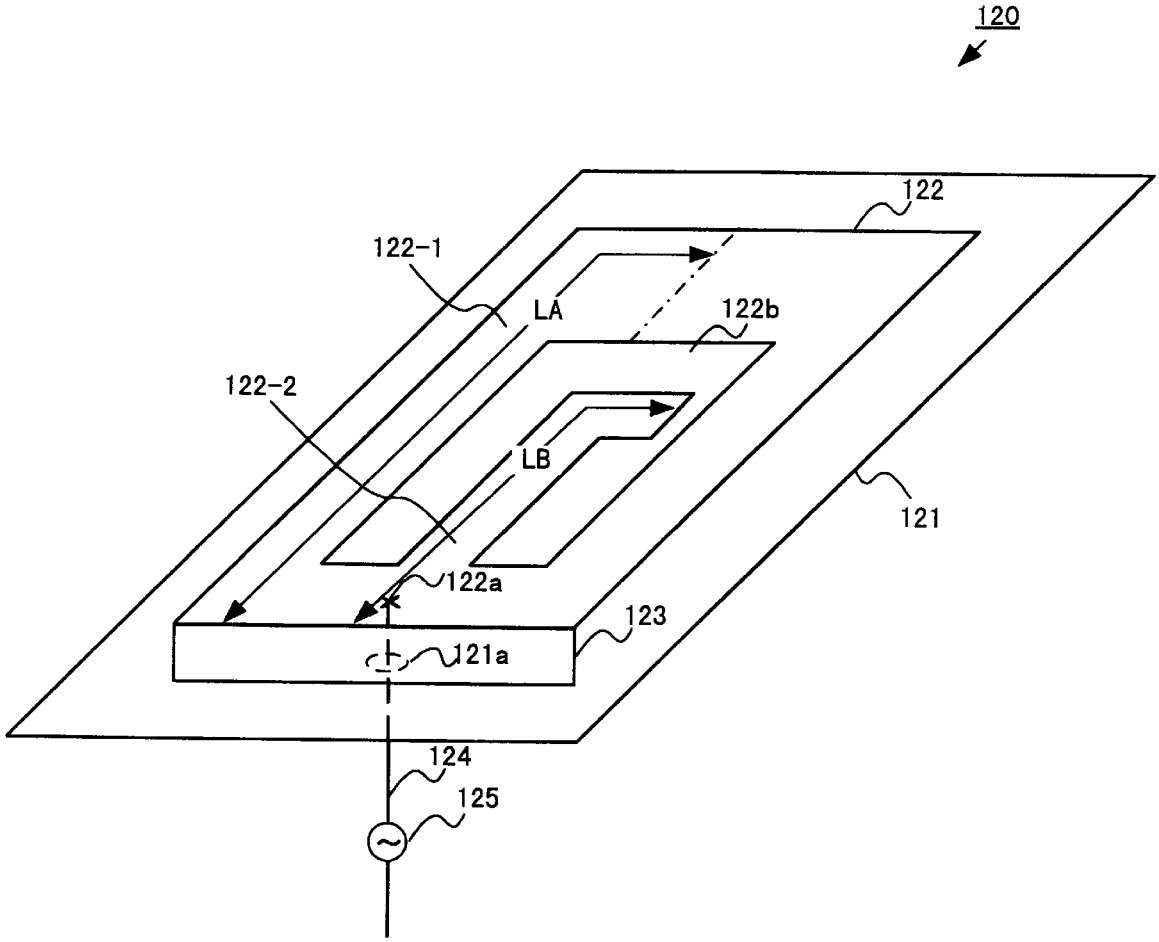
FIG. 12 is a perspective view showing a second embodiment of the multifrequency inverted F-type antenna according to the present invention.

FIG. 12 is a perspective view showing a second embodiment of a multifrequency inverted F-type antenna according to the present invention.

Referring to FIG. 12, in the multifrequency inverted F-type antenna 120, by forming a cut-out part 122*b* in emission conductor 122 provided with a feeding point 122*a*, whose one end is connected to short-circuit plate 123 planted in ground conductor 121, there are formed a first emission conductor 122-1 on the emission conductor 122, and an inverted L-shaped second emission conductor 122-2; by this means, this antenna is capable of receiving radio waves of two different frequency bands, namely, a first frequency band determined by the shape of the first emission conductor 122-1, and a second frequency band determined by the shape of the second emission conductor 122-2. Power is supplied through hole 121 a provided in ground conductor 121, by means of coaxial feeding line 124 from power feeding source 125, to the single feeding point 122*a* of emission conductor 122.

Thus, in the multifrequency inverted F-type antenna 120 shown in FIG. 12, the shape of the second emission conductor 122-2, compared with the multifrequency inverted F-type antenna 10 shown in FIG. 1, is different from the second emission conductor 12-2 of the multifrequency inverted F-type antenna 10 shown in FIG. 1.

Specifically, while the second emission conductor 12-2 of the multifrequency inverted F-type antenna 10 shown in FIG. 1 is formed in rectangular shape, the second emission conductor 122-2 of the multifrequency inverted F-type antenna 120 of the second embodiment shown in FIG. 12 is formed in inverted L shape. As a result, the shape of the cut-out part 122*b* in the multifrequency inverted F-type antenna 120 of the second embodiment shown in FIG. 12 is different from the shape of the cut-out part 12*b* of the multifrequency inverted F-type antenna 10 shown in FIG. 1.

With the above construction, thanks to the first emission conductor 122-1, the multifrequency inverted F-type antenna 120 resonates in the first frequency band in which length LA is approximately $\lambda/4$ ($\lambda$ is the wavelength) and resonates in the second frequency band in which the length LB is about $\lambda/4$ ($\lambda$ is the wavelength) thanks to the second emission conductor 122-2. Thus, with the multifrequency inverted F-type antenna 120 of the second embodiment also, it is possible to receive radio waves of the two frequency bands, namely, the first frequency band and second frequency band, without increase in the installation area or installation volume.

Figure 13:
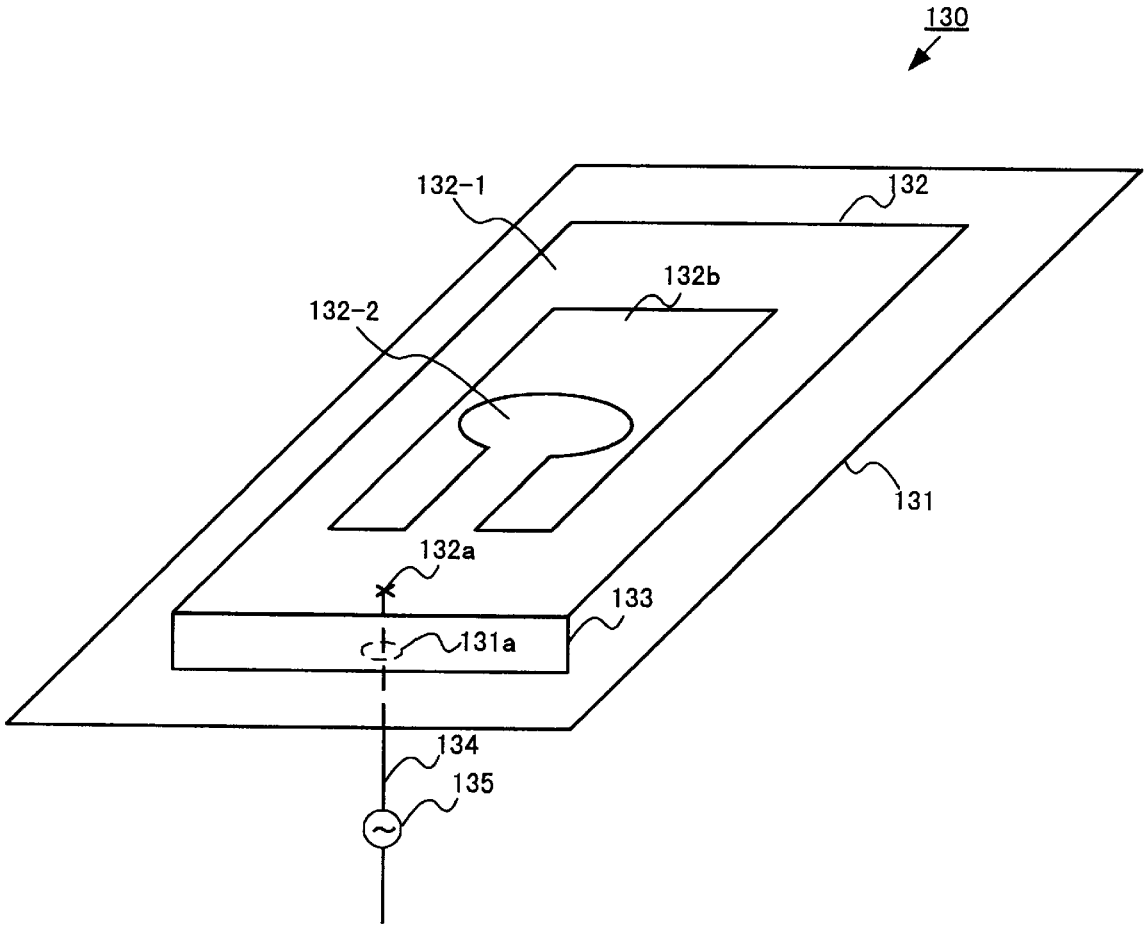
FIG. 13 is a perspective view showing a third embodiment of a multifrequency inverted F-type antenna according to the present invention.

FIG. 13 is a perspective view showing a third embodiment of a multifrequency inverted F-type antenna according to the present invention.

Referring to FIG. 13, in the multifrequency inverted F-type antenna 130, there is formed a cut-out part 132*b* in emission conductor 132 provided with a feeding point 132*a* and having one end thereof connected to a short-circuit plate 133 planted in ground conductor 131; a first emission conductor 132-1 and a second emission conductor 132-2 including a circular shape are thereby formed on the emission conductor 132. Thus the antenna is constituted so as to be capable of receiving radio waves of two different frequency bands, namely, a first frequency band determined by the shape of first emission conductor 132-1 and a second frequency band determined by the shape of second emission conductor 132-2. Power is supplied to the single feeding point 132*a* of emission conductor 132 by means of coaxial feeding line 134 from power feeding source 135, through a hole 131*a* provided in ground conductor 131.

With the multifrequency inverted F-type antenna 130 of the third embodiment also, radio waves of two frequency bands, namely, a first frequency band and a second frequency band, can be received without needing to increase either the installation area or installation volume.

It should be noted that the shapes of the second emission conductors 12-2, 32-2, 122-2, 132-2 formed on the emission conductors 12, 122, 132 in the first to third embodiments described above are not restricted to the rectangular shape as in the first embodiment shown in FIG. 1 or the inverted L shape as in the second embodiment shown in FIG. 12 or the shape including a curved circular shape as in the third embodiment shown in FIG. 13, but could be of any desired shape.

The shapes of the first emission conductors 12-1, 122-1, 132-1 formed on emission conductors 12, 122, 132 are not restricted to the shapes indicated in the first to third embodiments and any desired shape including for example a curve could be adopted.

Although, in the second to third embodiments, construction was effected by forming the first emission conductors 12-1, 122-1, 132-1 and second emission conductors 12-2, 122-2, 132-2 by providing cut-out parts 12*b*, 122*b*, 132*b* on emission conductors 12, 122, and 132, it would also be possible to form these by forming cut-out parts of rectangular shape or the like on emission conductors 12, 122, 132 and then subsequently connecting second emission conductors 12-2, 122-2, 132-2 in these cut-out parts.

Further, although, in the first to third embodiments, the first emission conductors 12-1, 122-1, 132-1 and second emission conductors 12-2, 122-2 and 132-2 were respectively arranged parallel to ground conductors 11, 121 and 131, there is no restriction to this, and first emission conductors 12-1, 122-1, 132-1 and second emission conductors 12-2, 122-2, and 132-2 need not be parallel with ground conductors 11, 121, 131.

Regarding the method of power supply, this is not restricted to the use of a coaxial lead and could be achieved using for example a strip lead or electromagnetic coupling etc.

Figure 14:
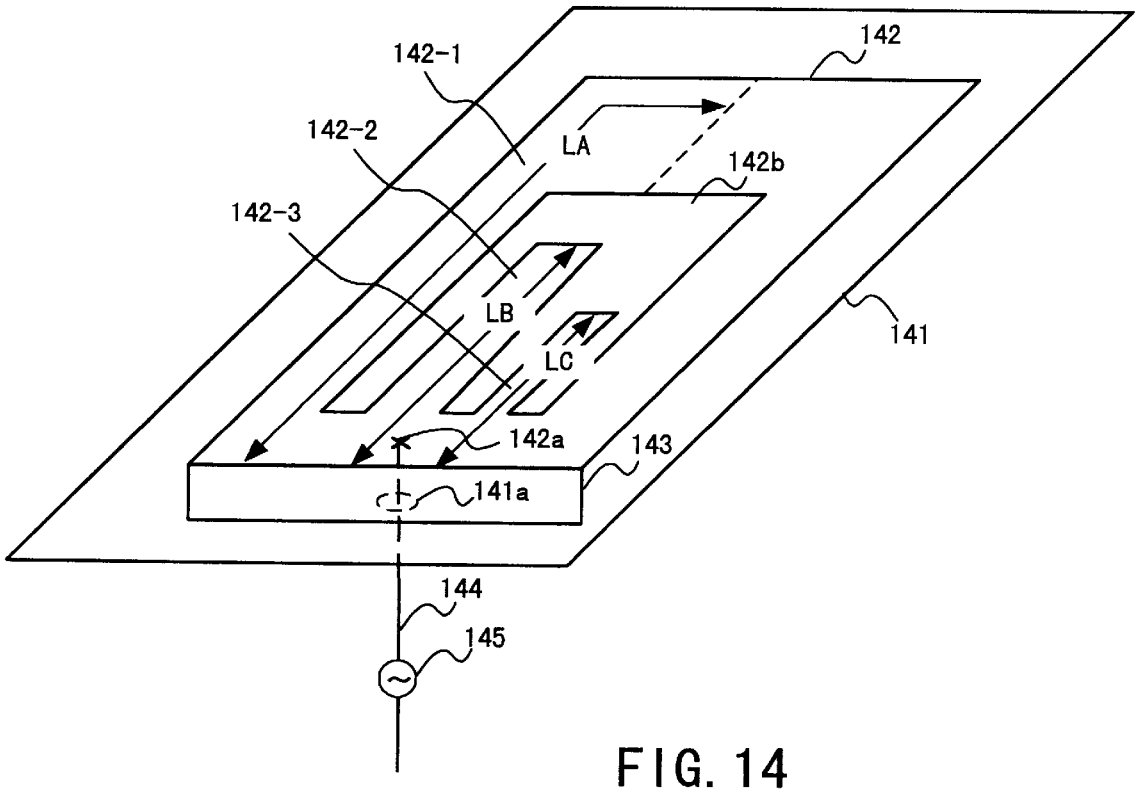
FIG. 14 is a perspective view showing a fourth embodiment of a multifrequency inverted F-type antenna according to the present invention.

FIG. 14 is a perspective view showing a fourth embodiment of a multifrequency inverted F-type antenna according to the present invention.

Referring to FIG. 14, in the multifrequency inverted F-type antenna 140, a first emission conductor 142-1 and second emission conductor 142-2 and second emission conductor 142-3 are formed on the emission conductor 142 by the formation of a cut-out part 142*b* on emission conductor 142 which is provided with a feeding point 142*a* and whose one end is connected with a short-circuit plate 143 planted in ground conductor 141. By this means, it is constituted such as to be capable of receiving radio waves of three different frequency bands, namely, a first frequency band determined by the shape of the first emission conductor 142-1, a second frequency band determined by the shape of the second emission conductor 142-2, and a third frequency band determined by the shape of the third emission conductor 142-3. Power is supplied to the single feeding point 142*a* of emission conductor 142 by coaxial feeding line 144 from power feeding source 145, through hole 141 a provided in ground conductor 141.

With the above construction, the multifrequency inverted F-type antenna 140 resonates in a first frequency band in which length LA is about $\lambda/4$ ($\lambda$ is the wavelength) using first emission conductor 142-1, resonates in the second frequency band in which length LB is about $\lambda/4$ ($\lambda$ is the wavelength) thanks to second emission conductor 142-2, and resonates in the third frequency band in which length LC is about $\lambda/4$ ($\lambda$ is the wavelength) thanks to the third emission conductor 142-3.

Thus, multifrequency inverted F-type antenna 120 according to the second embodiment is capable of receiving radio waves in the three frequency bands, namely, first frequency band, second frequency band and third frequency band, without increasing either the installation area or installation volume.

The shapes of the second emission conductor and third emission conductor 142-2 and 142-3 formed on emission conductor 142 are not restricted to the rectangular shapes shown in FIG. 14 and any desired shape could be adopted.

The shape of the first emission conductor 142-1 formed on the emission conductor 142 is not restricted to the shape shown in FIG. 14 but could be of any desired shape.

Although, in the fourth embodiment, the first to third emission conductors 142-1, 142-2, 142-3 were formed by providing cut-out part 142*b* on emission conductor 142, it would be possible to form these by forming a rectangular or the like cut-out part on emission conductor 142 and then subsequently connecting second emission conductor 142-2 and third emission conductor 142-3 within this cut-out part.

Further, although in the fourth embodiment described above first to third emission conductors 142-1, 142-2, 142-3 were formed parallel with ground conductor 141, just as in the case of the first to third embodiments, the first to third emission conductors 142-1, 142-2, 142-3 need not be parallel to ground conductor 141.

Further, although, in the fourth embodiment shown in FIG. 14, the arrangement was such that radio waves of three frequency bands, namely, a first frequency band, a second frequency band and a third frequency band, could be received by forming three emission conductors, namely, first to third emission conductors 142-1, 142-2, 142-3, on emission conductor 142, it would be possible to arrange to receive radio waves of multiple frequency bands of four or more, such as a fourth frequency and a fifth frequency, by forming four or more emission conductors on emission conductor 142.

In this case also, a multifrequency inverted F-type antenna can be implemented that is capable of receiving radio waves of four or more multiple frequency bands without increasing either the installation area or installation volume.

Figure 15:
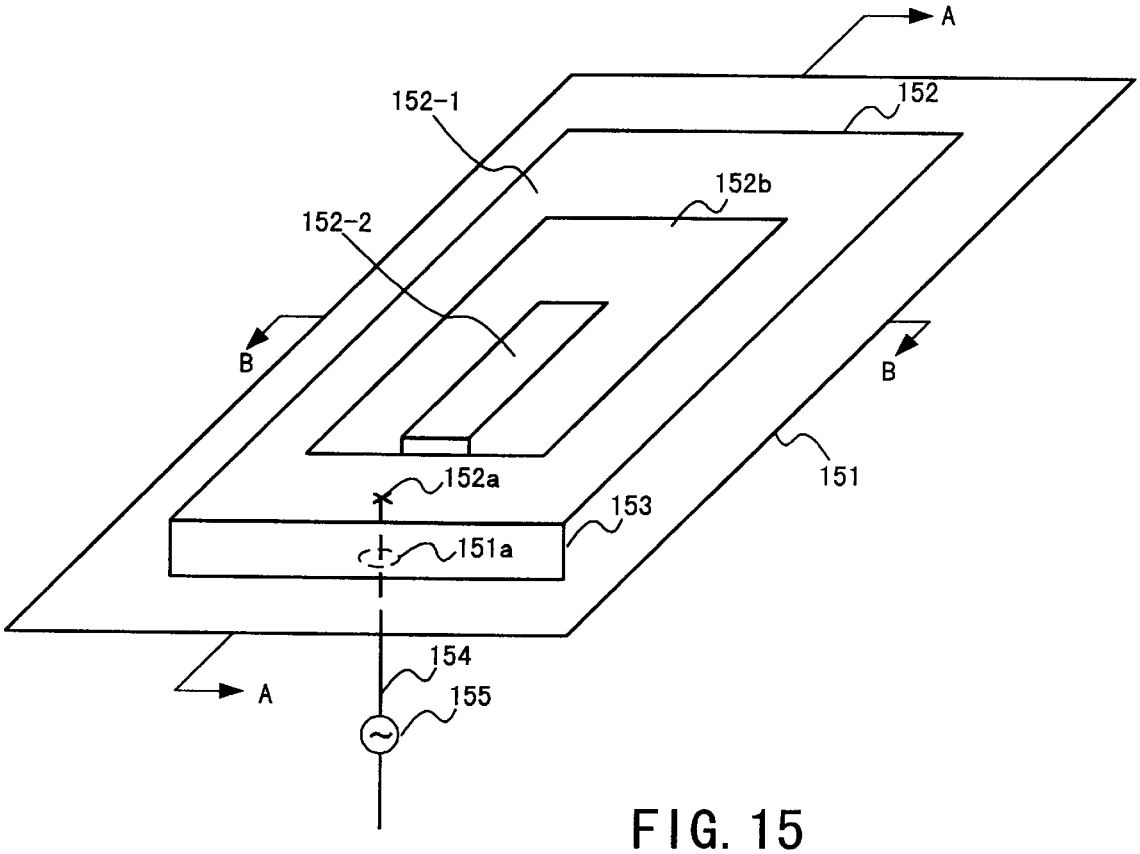
FIG. 15 is a perspective view showing a fifth embodiment of a multifrequency inverted F-type antenna according to the present invention.

FIG. 15 is a perspective view showing a fifth embodiment of a multifrequency inverted F-type antenna according to the present invention.

Figure 16A:
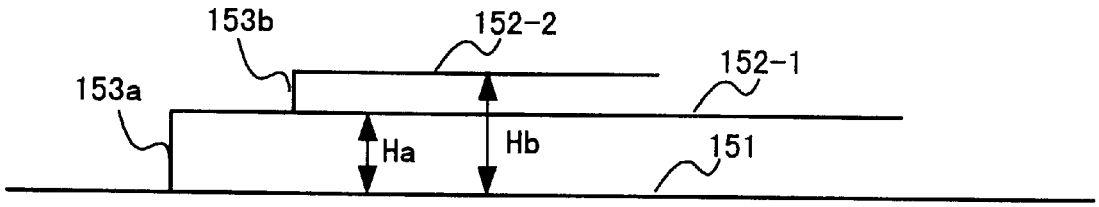
FIGS. 16(*a*) and 16(*b*) are cross-sectional views along the line A—A (FIG. 16(*a*)) and a perspective view along the line B—B (FIG. 16(*b*)) of the multifrequency inverted F-type antenna shown in FIG. 15.
Figure 16B:
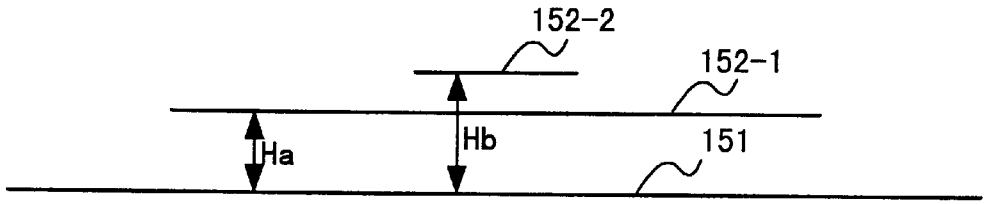

FIGS. 16(*a*) and 16(*b*) are cross-sectional views along the line A—A (FIG. 16(*a*)) and a cross-sectional view along the line B—B (FIG. 16(*b*)) of the multifrequency inverted F-type antenna shown in FIG. 15.

Referring to FIG. 15 and FIGS. 16(*a*) and 16(*b*), the multifrequency inverted F-type antenna 150 is formed with a first emission conductor 152-1 and second emission conductor 152-2 on an emission conductor 152 by forming a cut-out part 152*b* on the emission conductor 152 which is provided with a feeding point 152*a* and one end of which is connected to a short-circuit plate 153 planted in a ground conductor 151; furthermore, the distance Hb of second emission conductor 152-1 and ground conductor 151 is arranged to be capable of being adjusted by the provision of an upright part 153*b* on second emission conductor 152-2.

With the above arrangement, in the multifrequency inverted F-type antenna 150, it is possible to vary the bandwidth of the second frequency band determined by the shape of the second emission conductor 152-2, by adjusting the distance Hb of second emission conductor 152-2 and ground conductor 151 by varying the height of upright part 153*b* provided on second emission conductor 152-2.

Specifically, the distance Hb of the second emission conductor 152-2 and the ground conductor 151 is related to the bandwidth of the second frequency band, which is determined by the shape of second emission conductor 152-2. Consequently, for example by increasing the distance Hb of the second emission conductor 152-2 and ground conductor 151, the bandwidth of the second frequency band that is determined by the shape of second emission conductor 152-2 can be made wider and, by lowering the distance Hb of the second emission conductor 152-2 and ground conductor 151, the bandwidth of the second frequency band determined by the shape of the second emission conductor 152-2 can be made narrower.

Likewise, if the distance Ha of the first emission conductor 152-1 and ground conductor 151 is increased by adjusting the height of short-circuit plate 153*a,* the bandwidth of the first frequency band determined by the shape of the first emission conductor 152-1 can be made wider and, by lowering the distance Ha of the first emission conductor 152-1 and ground conductor 151, the bandwidth of the first frequency band determined by the shape of the first emission conductor 152-1 can be made narrower.

It should be noted that, although in the fifth embodiment illustrated in FIG. 15 and FIGS. 16(*a*) and 16(*b*) the distance Hb between the second emission conductor 152-2 and ground conductor 151 was arranged to be capable of being adjusted by the provision of upright part 153*b* on second emission conductor 152-2, it would also be possible to adjust the distance Hb of the second emission conductor 152-2 and ground conductor 151 by providing a downwardly directed part on the second emission conductor 152-2.

Figure 17A:
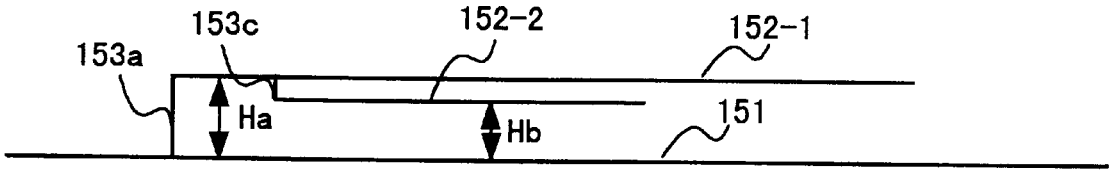
FIGS. 17(*a*) and 17(*b*) show cross-sectional views along the line A—A (FIG. 17(*a*)) and a cross-sectional view along the line B—B (FIG. 18(*b*)) corresponding to FIGS. 16(*a*) and 16(*b*), constituted such as to enable adjustment of the distance Hb between the second emission conductor 152-2 and ground conductor 151, by the provision of a downwardly directed part 153*c* in place of the upwardly directed part 153*a* of second emission conductor 152-2 in the construction shown in FIG. 15.
Figure 17B:
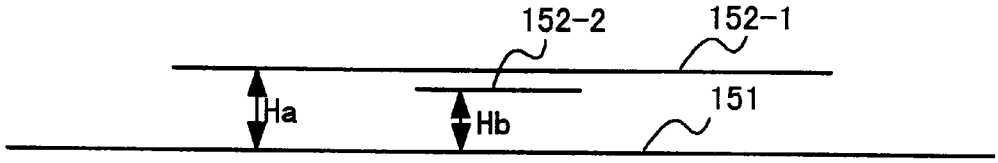

FIGS. 17(*a*) and 17(*b*) are cross-sectional views along the line A—A (FIG. 17(*a*)) and a cross-sectional view along the line B—B (FIG. 17(*b*)) corresponding to FIGS. 16(*a*) and 16(*b*), constituted such that it is possible to adjust the distance Hb between the second emission conductor 152-2 and ground conductor 151 by the provision of a downwardly directed part 153*c* instead of the upright part 153*a* of second emission conductor 152-2 in the construction illustrated in FIG. 15.

With the embodiment shown in FIGS. 17(*a*) and 17(*b*) also, by increasing the distance Hb of the second emission conductor 152-2 and ground conductor 151, the bandwidth of the second frequency band determined by the shape of the second emission conductor 152-2 can be made wider, and, by lowering the distance Hb between the second emission conductor 152-2 and the ground conductor 151, the bandwidth of the second frequency band that is determined by the shape of the second emission conductor 152-2 can be made narrower.

Likewise, if the distance Ha of the first emission conductor 152-1 and ground conductor 151 is increased by adjusting the height of short-circuit plate 153*a,* the bandwidth of the first frequency band determined by the shape of the first emission conductor 152-1 can be made wider, and, by lowering the distance Ha of the first emission conductor 152-1 and ground conductor 151, the bandwidth of the first frequency band determined by the shape of the first emission conductor 152-1 can be made narrower.

It should be noted that with for example a multifrequency inverted F-type antenna 30 according to the first embodiment shown in FIG. 3, as shown in FIG. 5, the bandwidth of the second frequency band that is determined by the shape of the second emission conductor 12-2 is wider than the bandwidth of the first frequency band that is determined by the shape of the first emission conductor 12-1, but, if the construction of FIGS. 17(*a*) and 17(*b*) is adopted, it is possible to set the bandwidth of the second frequency band and the bandwidth of the first frequency band to be practically the same.

Although, with the construction illustrated in FIG. 15 and FIGS. 16(*a*) and 16(*b*), the volume of the multifrequency inverted F-type antenna 150 is increased by an amount corresponding to the height of upright part 153*b* provided on second emission conductor 152-2, with the construction illustrated in FIGS. 17(*a*) and 17(*b*), this increase in volume does not occur.

It should be noted that, in the above first to fifth embodiments, the resonant frequencies and their bandwidths can be made variable by inserting respective dielectric elements between ground conductors 11, 121, 131, 141, 151 and first emission conductors 12-1, 122-1, 131-1, 141-1, 151-1 and second emission conductors 12-2, 122-2, 131-2, 141-2, 151-2.

That is, if the dielectric constant of the dielectric element inserted between ground conductors 11, 121, 131, 141, 151 and first emission conductor 12-1, 122-1, 131-1, 141-1, 151-1 and the second emission conductors 12-2, 122-2, 131-2, 141-2, and 151-2 is increased, the resonance frequency can be lowered and the bandwidth narrowed; contrariwise, if the dielectric constant of the dielectric elements respectively inserted between ground conductors 11, 121, 131, 141, 151 and first emission conductors 12-1, 122-1, 131-1, 141-1, 151-1 and second emission conductors 12-2, 122-2, 131-2, 141-2, and 151-2 is lowered, the resonance frequency can be raised and the bandwidth made wider.

Figure 18A:
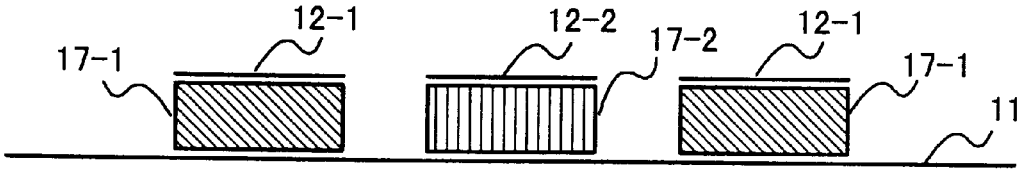
FIGS. 18(*a*) and 18(*b*) are cross-sectional views showing a sixth embodiment of a multifrequency inverted F-type antenna constituted by inserting a dielectric element between the ground conductor and first emission conductor and second emission conductor.
Figure 18B:
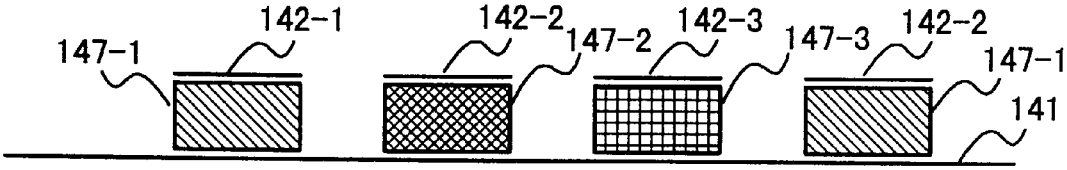

FIGS. 18(*a*) and 18(*b*) are cross-sectional views illustrating a sixth embodiment of a multifrequency inverted F-type antenna constituted by inserting dielectric elements between the ground conductor and first emission conductor and second emission conductor.

Of FIGS. 18(*a*) and 18(*b*), 18(*a*) illustrates a multifrequency inverted F-type antenna constituted by inserting dielectric elements of respectively different dielectric constants between the ground conductor 11 and first emission conductor 12-1 and second emission conductor 12-2 in the multifrequency inverted F-type antenna 10 of the first embodiment illustrated in FIG. 1.

In FIG. 18(*a*), a first dielectric element 17-1 having a first dielectric constant is inserted between a ground conductor 11 and first emission conductor 12-1, and a second dielectric element 17-2 having a second dielectric constant is inserted between ground conductor 11 and second emission conductor 12-2.

With such a construction, the resonance frequency and bandwidth of the multifrequency inverted F-type antenna can be respectively varied by suitably selecting the first dielectric constant of the first dielectric element 17-1 inserted between ground conductor 11 and first emission conductor 12-1 and the second dielectric constant of the second dielectric element 17-2 inserted between the ground conductor 11 and second emission conductor 12-2.

For example, it is possible to set the bandwidth of the first frequency band and the bandwidth of the second frequency band to be practically equal by making the first dielectric constant of the first dielectric element 17-1 lower than the second dielectric constant of the second dielectric element.

FIG. 18(*b*) illustrates a multifrequency inverted F-type antenna constituted by inserting dielectric elements of respectively different dielectric constants between ground conductor 141 and first emission conductor 142-1, second emission conductor 142-2, and third emission conductor 142-3 in the multifrequency inverted F-type antenna according to the fourth embodiment illustrated in FIG. 14.

In FIG. 18(*b*), a first dielectric element 147-1 having a first dielectric constant is inserted between ground conductor 141 and first emission conductor 142-1; a second dielectric element 147-2 having a second dielectric constant is inserted between ground conductor 141 and second emission conductor 142-2; and a third dielectric element 147-3 having a third dielectric constant is inserted between ground conductor 141 and third emission conductor 142-3.

With this arrangement, by suitably respectively selecting the first dielectric constant of the first dielectric element 147-1 inserted between ground conductor 141 and first emission conductor 142-1, the second dielectric constant of the second dielectric element 147-2 inserted between the ground conductor 141 and second emission conductor 142-2, and the third dielectric constant of the third dielectric element 147-3 inserted between the ground conductor 141 and third emission conductor 142-3, the resonance frequencies and their bandwidths of the multifrequency inverted F-type antenna can be respectively varied.

It should be noted that, in the multifrequency inverted F-type antenna of the sixth embodiment illustrated in FIGS. 18(*a*) and 18(*b*), it is possible to employ dielectric elements of the same dielectric constant as dielectric elements 17-1, 17-2,147-1, 147-2,147-3, or it is also possible to make the dielectric constant that of air with the exception of at least one of these.

With the multifrequency inverted F-type antenna of the sixth embodiment illustrated in FIGS. 18(*a*) and 18(*b*), by insertion of the dielectric elements 17-1,17-2, 147-1, 147-2, 147-3, the thickness of the multifrequency inverted F-type antenna (i.e. the volume) can be further reduced, and the resonance frequencies and their bandwidths can be individually adjusted.

Although, in the first to sixth embodiments described above, short-circuit plates 13, 123, 133, 143, and 153*a* were arranged so as to be connected across the entire width of emission conductors 12, 122, 132, 142 and 152, it would be possible to make the length of short-circuit plates 13, 123, 133, 143, 153*a* shorter than the length of emission conductors 12, 122, 132, 142, 152 or to adopt a construction in which the centers of short-circuit plates 13, 123, 133, 143, 153*a* are offset from the centers of emission conductors 12, 122, 132, 142, 152.

Figure 19:
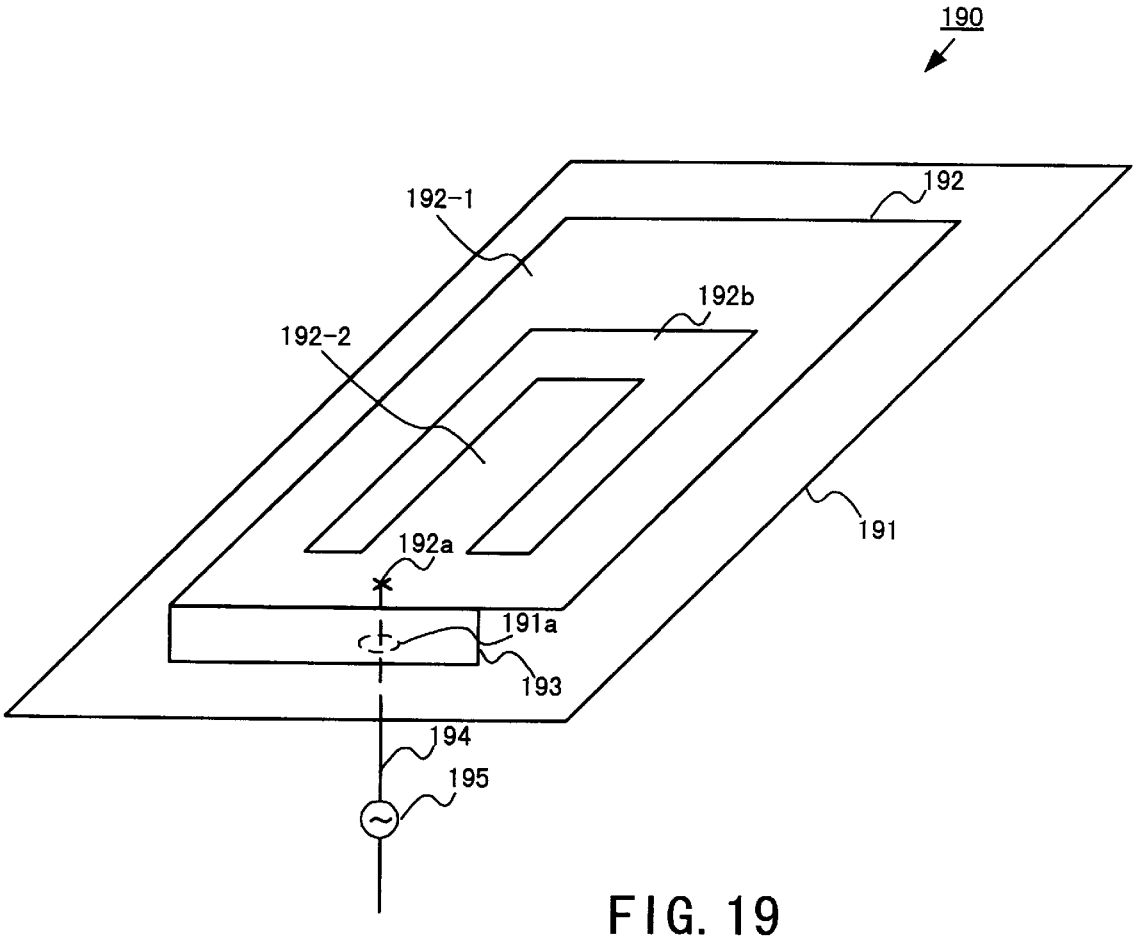
FIG. 19 is a perspective view showing a seventh embodiment of a multifrequency inverted F-type antenna according to the present invention.

FIG. 19 shows a perspective view of a seventh embodiment of a multifrequency inverted F-type antenna according to the present invention.

In FIG. 19, in the multifrequency inverted F-type antenna 190, a short-circuit plate 193 constituted to be shorter than emission conductor 192 is planted by cutting away part thereof on ground conductor 191. Emission conductor 192 provided with a feeding point 192*a* is connected to the short-circuit plate 193. A cut-out part 192*b* is formed in the emission conductor 192, thereby forming a first emission conductor 192-1 and second emission conductor 192-2 on the emission conductor 192. It is thereby made possible to receive radio waves of two different frequency bands, mainly, a first frequency band determined by the shape of the first emission conductor 1921, and a second frequency band determined by the shape of the second emission conductor 192-2. Also, power is supplied to the single feeding point 192*a* of emission conductor 192 by means of coaxial feeding line 194 from power feeding source 195 through a hole 191 a provided in ground conductor 191.

With such a construction, the effective resonance length of first emission conductor 192-1 and second emission conductor 192-2 can be altered, thereby making possible further miniaturization of the multifrequency inverted F-ype antenna 190.

Although, in the first to seventh embodiments described above, feeding points 12*a*, 122*a*, 132*a*, 142*a*, 152*a*, 192*a* were provided at the centers of emission conductors 12, 122, 132, 142, 152, and 192, it would also be possible to provide feeding points 12*a*, 122*a*, 132*a*, 142*a*, 152*a*, and 192*a* in positions offset from the centers of emission conductors 12, 122, 132, 142, 152 and 192.

Figure 20:
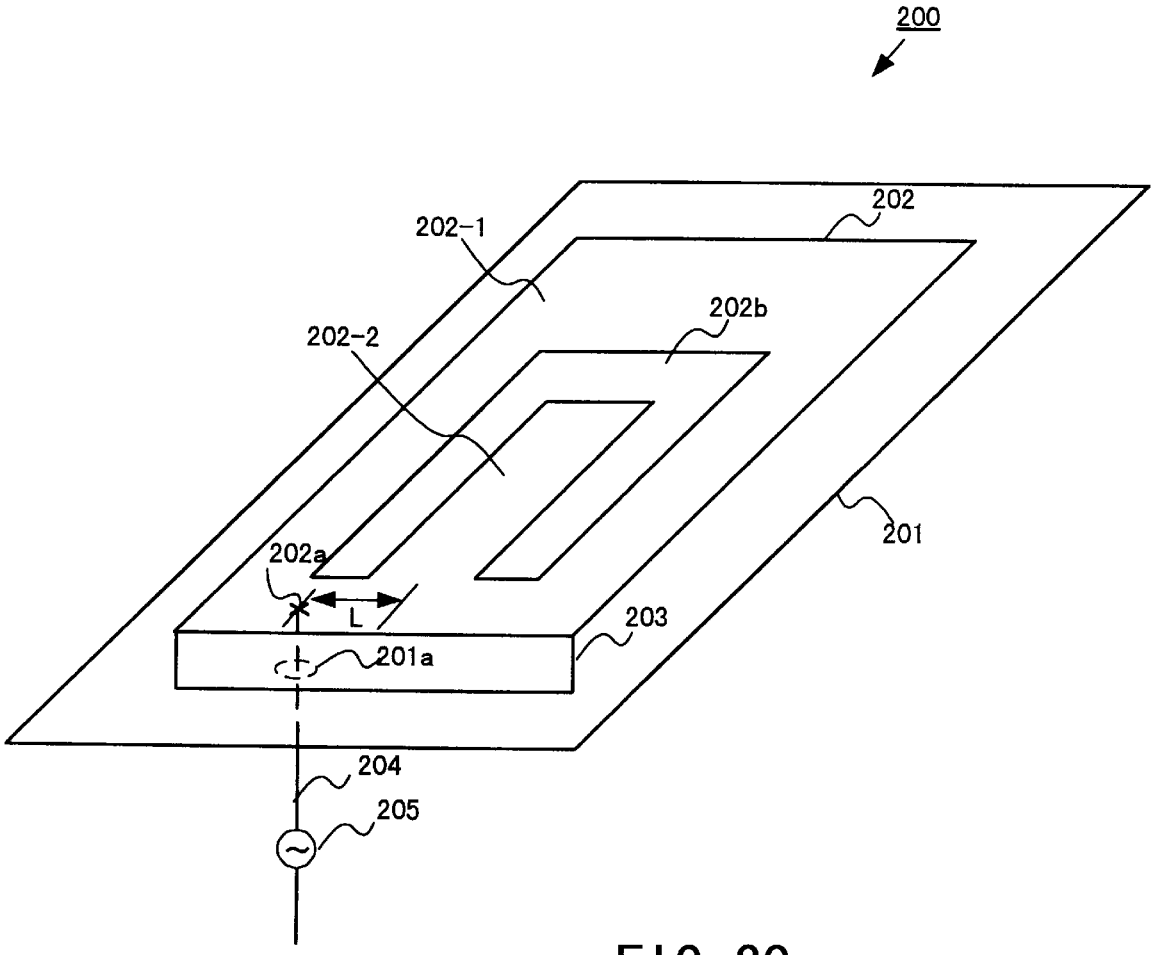
FIG. 20 is a perspective view showing an eighth embodiment of a multifrequency inverted F-type antenna according to the present invention.
Figure 21:
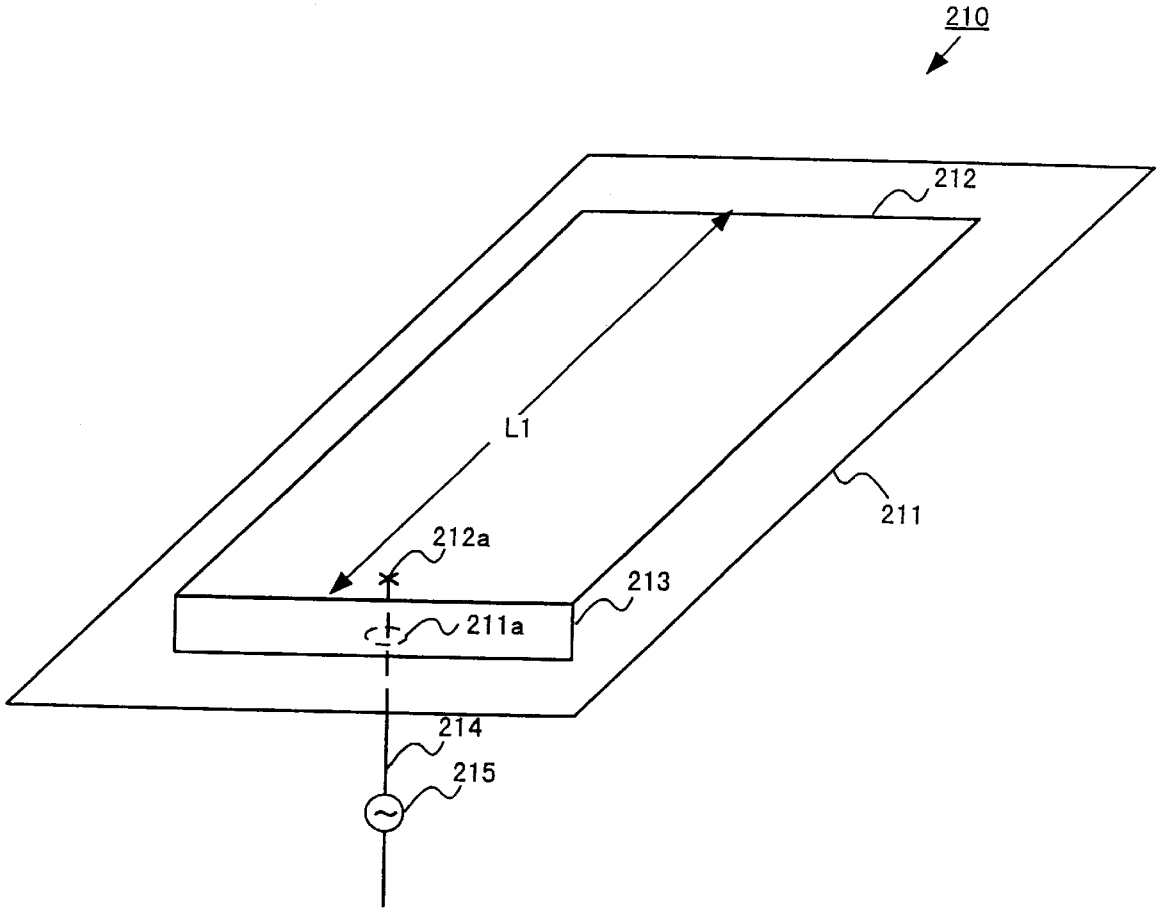
FIG. 21 Prior Art
FIG. 21 is a perspective view showing the typical construction of a conventional inverted F-type antenna.

FIG. 20 is a perspective view showing an eighth embodiment of a multifrequency inverted F-type antenna according to the present invention.

Referring to FIG. 20, in the multifrequency inverted F-type antenna 200, there are formed a first emission conductor 202-1 and second emission conductor 202-2 on emission conductor 202 by forming a cut-out part 202*b* in the emission conductor 202 whose one end is connected to short-circuit plate 203 that is planted in ground conductor 201. Thus it is made possible to receive radio waves of two different frequency bands, namely, a first frequency band determined by the shape of first emission conductor 202-1 and a second frequency band determined by the shape of second emission conductor 202-2.

A feeding point 202*a* is provided at a position offset by L from the center of emission conductor 202, and power is supplied to the feeding point 202*a* by coaxial feeding line 204 from power feeding source 205 through a hole 201 a provided in ground conductor 201.

With such a construction, matching with a sending/receiving circuit, not shown, in which the multifrequency inverted F-type antenna 200 is employed can be achieved by adjusting the position of the feeding point 202*a*.

Industrial Applicability

The present invention consists in a multifrequency inverted F-type antenna for use chiefly as the internal antenna of a small, thin radio communication terminal such as a portable telephone, whereby radio waves in a plurality of frequency bands can be received without making the size of the antenna large.

According to the present invention, a construction is provided whereby radio waves of two different frequency bands can be received, namely, a first frequency band determined by the shape of a first emission conductor and a second frequency band determined by the shape of a second emission conductor, by forming a first emission conductor and second emission conductor that resonate in respective different frequency bands on an emission conductor, by forming a cut-out part in the emission conductor, which is provided with a feeding point and whose one end is connected to a short-circuit plate planted in a ground conductor; a multiple-frequency inverted F-type antenna of small size and small thickness can thereby be implemented with low cost without increasing either the installation area or installation volume.

What is claimed is:

1. A multifrequency inverted F-type antenna comprising:

a ground conductor element;

a short-circuit element disposed on the ground conductor element;

a first radiation conductor element spaced apart from the ground conductor element being connected to the short-circuit element at a first end connection portion of the first radiation conductor element and having a hole;

a second radiation conductor element disposed in the hole of the first radiation conductor element, being connected to the first radiation conductor element at a second end connection portion of the second radiation conductor element and being spaced apart from the ground conductor plate; and a feeding point connection part disposed on the first radiation conductor element between the first end connection portion and the second end connection portion, for feeding signals to the first and second radiation conductor elements.

2. The multifrequency inverted F-type antenna according to claim 1 wherein the second radiation conductor element is formed integrally with the first radiation conductor element.

3. The multifrequency inverted F-type antenna according to claim 1 wherein the second radiation conductor element has a single projection and operates in two frequency bands dependent on shapes of the first radiation conductor element and the second radiation conductor element.

4. The multifrequency inverted F-type antenna according to claim 3 wherein respectively different distances are set for a first spacing between the first radiation conductor element and the ground conductor element, and a second spacing between the second radiation conductor element and the ground conductor element.

5. The multifrequency inverted F-type antenna according to claim 3 wherein a dielectric element is arranged in at least one of the first and second spacings, so that a first dielectric constant between the first radiation conductor element and the ground conductor element and a second dielectric constant between the second radiation conductor element and the ground conductor element are made different.

6. The multifrequency inverted F-type antenna according to claim 1 wherein the second radiation conductor element has a plurality of projections and operates in a plurality of frequency bands dependent on shapes of the first radiation conductor element and the second radiation conductor element.

7. The multifrequency inverted F-type antenna according to claim 6 wherein respectively different distances are set for a first spacing between the first radiation conductor element and the ground conductor element, and a plurality of second spacings between each of the plurality of projections of the second radiation conductor element and the ground conductor element.

8. The multifrequency inverted F-type antenna according to claim 6 wherein dielectric element is arranged in at least one of a spacing between the first radiation conductor element and the ground conductor element and spacings between each of the projections of the second radiation conductor element and the ground conductor element, so that a first dielectric constant between the first radiation conductor element and the ground conductor element and a second dielectric constant between the projections of the second radiation conductor element and the ground conductor element, respectively, are made to be different.

9. The multifrequency inverted F-type antenna according to claim 1 wherein the feeding point is arranged in the middle of the feeding point connection part in the width direction of the first radiation conductor element.

10. The multifrequency inverted F-type antenna according to claim 1 wherein the feeding point is arranged at a position offset by a prescribed distance from the middle of the feeding point connection part in the width direction of the first radiation conductor element.

11. The multifrequency inverted F-type antenna according to claim 1 wherein the short-circuit element is formed of a length the same as a length of the first radiation conductor element in the width direction.

12. The multifrequency inverted F-type antenna according to claim 1 wherein the short-circuit element is formed of a shorter length than a length of the first radiation conductor element in the width direction and with its center offset from the center of the first radiation conductor element in the width direction.

13. A multifrequency inverted F-type antenna comprising:

a ground conductor element;

a short-circuit element disposed on the ground conductor element;

a first radiation conductor element facing the ground conductor element, being connected to the short-circuit element at a first end connection portion of the first radiation conductor element and having a cut-out part in the interior thereof;

a second radiation conductor element formed inside the cut-out part of the first radiation conductor element, facing the ground conductor element and being connected to the first radiation conductor element at a second end connection portion of the second radiation conductor element; and a feeding point connection part provided between the first end connection portion and the second end connection portion, for feeding signals to the first and second radiation conductor elements.

14. A multifrequency inverted F-type antenna comprising:

a ground conductor element;

a short-circuit element planted on the ground conductor element;

a first radiation conductor element facing the ground conductor element, one end of the first radiation conductor being connected to the short-circuit element and having a cut-out part in the interior thereof;

a second radiation conductor element formed inside the cut-out part of the first radiation conductor element and facing the ground conductor element and being connected to the first radiation conductor element; and a feeding point connection part provided between the cut-out part and the short-circuit element, for providing signals to the first and second radiation conductor elements.

* * * * *